US005282141A

United States Patent [19]

Faas et al.

[11] Patent Number: 5,282,141

[45] Date of Patent: Jan. 25, 1994

[54] METHOD OF BLENDING TEXTILE FIBERS

[75] Inventors: Jurg Faas, Dinhard; Roger Alther, Neuhausen; Robert Moser, Winterthur; Robert Demuth, Nurensdorf, all of Switzerland

[73] Assignee: Rieter Machine Works, Ltd., Winterthur, Switzerland

[21] Appl. No.: 536,206

[22] Filed: Jun. 11, 1990

[30] Foreign Application Priority Data

Jun. 16, 1989 [DE] Fed. Rep. of Germany ..... 3919746

[51] Int. Cl.[5] ..... D01G 7/00; D01G 13/00

[52] U.S. Cl. ..... 364/470; 19/105; 19/81; 19/80 R; 19/145.5

[58] Field of Search ..... 364/470; 19/145.5, 80 R; 177/1

[56] References Cited

U.S. PATENT DOCUMENTS

| | | | |
|---|---|---|---|
| 4,448,272 | 5/1984 | Keller et al. | 177/1 |
| 4,455,714 | 6/1984 | Goldammer et al. | 19/145.5 |
| 4,587,691 | 5/1986 | Hosel | 19/80 R |
| 4,908,910 | 3/1990 | Pinto et al. | 19/145.5 |
| 4,920,613 | 5/1990 | Binder et al. | 19/145.5 |
| 4,991,387 | 2/1991 | Tashiro et al. | 19/145.5 |
| 5,025,533 | 6/1991 | Faas et al. | 19/145.5 |

FOREIGN PATENT DOCUMENTS

| | | |
|---|---|---|
| 196821 | 6/1907 | Fed. Rep. of Germany . |
| 1685596 | 7/1971 | Fed. Rep. of Germany . |
| 2626648 | 12/1977 | Fed. Rep. of Germany . |
| 2939890 | 7/1981 | Fed. Rep. of Germany . |
| 3151063 | 7/1983 | Fed. Rep. of Germany . |

OTHER PUBLICATIONS

Wegener, Walther: Die Mischungsungleich Mäbigkeit, Jul./Aug. 1983, Textilbe trieb, H 7/8 pp. 23-25, 28-31.

*Primary Examiner*—Jerry Smith
*Assistant Examiner*—Jim Trammell
*Attorney, Agent, or Firm*—Francis C. Hand

[57] ABSTRACT

The method for mixing textile fibers utilizes a computer which is inputted with data concerning the characteristics of the fibers of the individual fiber bales to be processed as well as the data indicative of the desired characteristics of the board sliver or yarn which is to be manufactured from the fiber mixture obtained from the fibers of the individual bales. From the inputted data, the computer, in accordance with a predetermined computing algorithm, calculates a component distribution which comes close to the estimated component distribution and which satisfies the desired characteristics of the car sliver or yarn characteristics. The computer may also effect a correction of the computed component distribution taking into account boundary conditions with additional inputted information. The component distribution found by the computer is used for the adjustment or regulation of the supply of individual fiber components to a mixer in order to obtain the calculated component distribution in the fiber mixture which si delivered by the mixer.

20 Claims, 11 Drawing Sheets

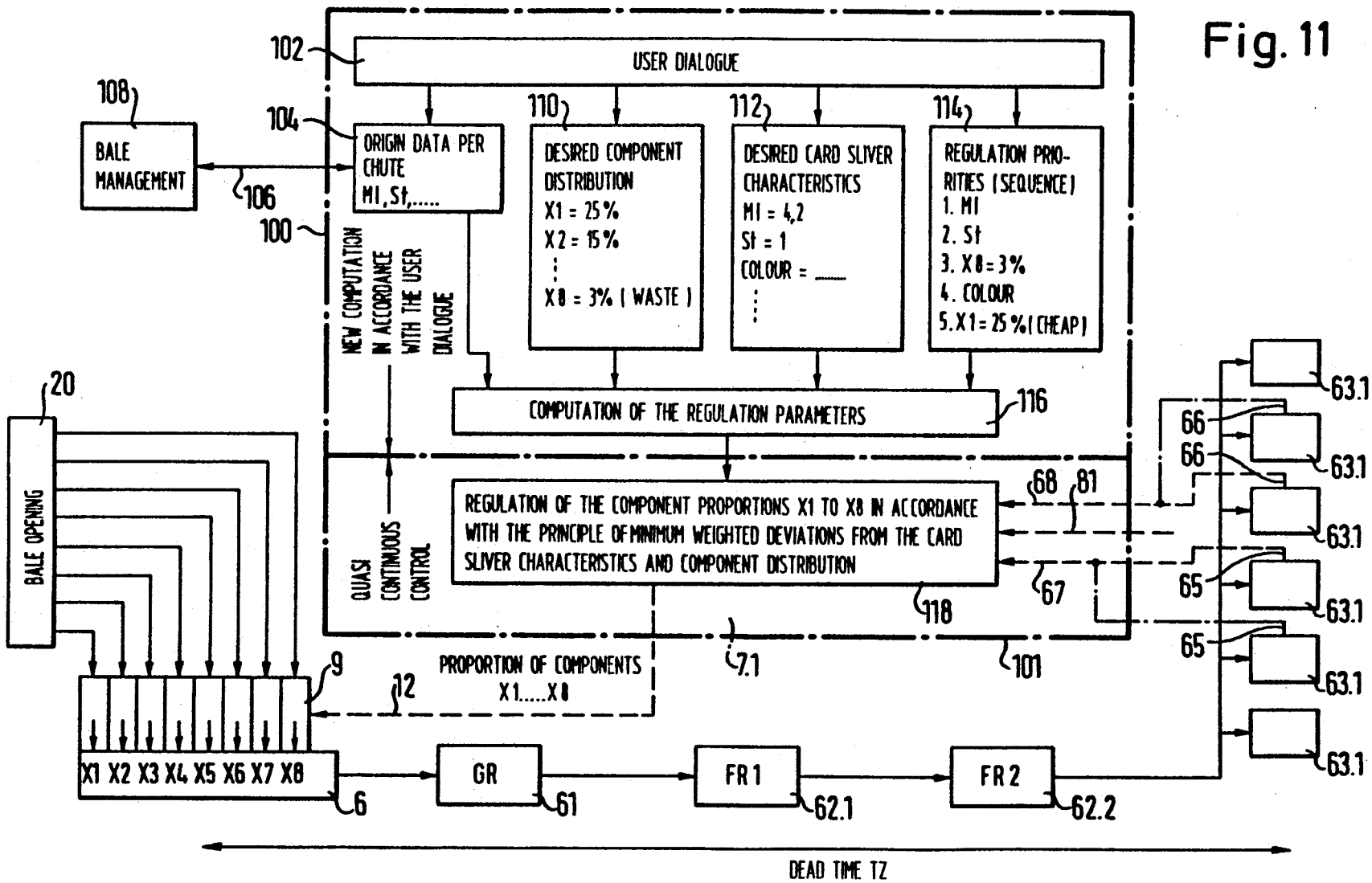
Fig. 11
USER DIALOGUE
ORIGIN DATA PER CHUTE M1, S1,.....
DESIRED COMPONENT DISTRIBUTION X1 = 25% X2 = 15% ... X8 = 3% (WASTE)
DESIRED CARD SLIVER CHARACTERISTICS M1 = 4,2 S1 = 1 COLOUR = ..... ....
REGULATION PRO-RITES (SEQUENCE) 1. M1 2. S1 3. X8 = 3% 4. COLOUR 5. X1 = 25% (CHEAP)
COMPUTATION OF THE REGULATION PARAMETERS
REGULATION OF THE COMPONENT PROPORTIONS X1 TO X8 IN ACCORDANCE WITH THE PRINCIPLE OF MINIMUM WEIGHTED DEVIATIONS FROM THE CARD SLIVER CHARACTERISTICS AND COMPONENT DISTRIBUTION
NEW COMPUTATION IN ACCORDANCE WITH THE USER DIALOGUE
QUASI CONTINUOUS CONTROL
PROPORTION OF COMPONENTS X1....X8
BALE MANAGEMENT
BALE OPENING
X1 X2 X3 X4 X5 X6 X7 X8
GR
FR1
FR2
DEAD TIME TZ
63.1
66
65
68
81
67
101
71
102
104
106
100
108
110
112
114
116
118
20
9
12
6
61
62.1
62.2

Fig. 15

TABLE I

YEAR 1990 MONTH 4 DAY 25 HOUR 15 MINUTE 33 SEC. 6

COMPONENT

| X1 | X2 | X3 | X4 | X5 | X6 |
|---|---|---|---|---|---|
| STAPLE OF COMPONENTS | | | | | |
| 15.5000 | 18.9000 | 18.3000 | 17.6000 | 12.0000 | 14.0000 |
| FINENESS OF COMPONENTS | | | | | |
| 4.3400 | 3.7000 | 4.1000 | 4.6000 | 3.8000 | 3.8000 |
| COLOUR VALUES OF COMPONENTS FAK | | | | | |
| 1 | 1 | 1 | 1 | 1 | 1 |
| COLOUR VALUES OF COMPONENTS FBK | | | | | |
| 2.3000 | 3.6000 | 4.8000 | 3.0000 | 3.6000 | 3.8000 |
| PRICE OF COMPONENTS | | | | | |
| 2.7000 | 3.0200 | 2.7400 | 2.6300 | 1.9000 | 2.0000 |

---------- RESULT OF OPTIMISATION ----------

STAPLE OF MIXTURE = 15.97 ( S = 16 W = 1 )
FINENESS OF MIXTURE = 4.018 ( S = 4 W = 1 )
COLOUR VALUE A OF MIXTURE = 1 ( S = 1 W = 0 )
COLOUR VALUE B OF MIXTURE = 3.009 ( S = 3 W = 1 )
PRICE OF MIXTURE = 2.581 ( S = 0 W = 0.001 )
VALUE OF LOSS FUNCTION 0
MIXING VECTOR C1

| | | | | | |
|---|---|---|---|---|---|
| 0.3302 | 0.3469 | -0.0971 | 0.1289 | 0.1333 | 0.1579 |

---------- RESULT OF POST OPTIMISATION ----------

STAPLE OF MIXTURE = 15.98 ( 16 )
FINENESS OF MIXTURE = 4.028 ( 4 )
COLOUR VALUE A OF MIXTURE = 1 ( 1 )
COLOUR VALUE B OF MIXTURE = 3.009 ( 3 )
PRICE OF MIXTURE = 2.631
VALUE OF LOSS FUNCTION = 0
MIXING VECTOR C2

| | | | | | |
|---|---|---|---|---|---|
| 0.4536 | 0.3101 | 0 | 0.0171 | 0.1400 | 0.0791 |

Fig. 16

TABLE II

YEAR 1990 MONTH 4 DAY 25 HOUR 15 MINUTE 33 SEC. 6

COMPONENT

| X 1 | X 2 | X 3 | X 4 | X 5 | X 6 |
|---|---|---|---|---|---|
| STAPLE OF COMPONENTS | | | | | |
| 15.5000 | 18.9000 | 18.3000 | 17.6000 | 12.0000 | 14.0000 |
| FINENESS OF COMPONENTS | | | | | |
| 4.3400 | 3.7000 | 4.1000 | 4.6000 | 3.8000 | 3.8000 |
| COLOUR VALUES OF COMPONENTS FAK | | | | | |
| 1 | 1 | 1 | 1 | 1 | 1 |
| COLOUR VALUES OF COMPONENTS FBK | | | | | |
| 2.3000 | 3.6000 | 4.8000 | 3.0000 | 3.6000 | 3.8000 |
| PRICE OF COMPONENTS | | | | | |
| 2.7000 | 3.0200 | 2.7400 | 2.6300 | 1.9000 | 2.0000 |

---------- RESULT OF OPTIMISATION ----------

| | | | |
|---|---|---|---|
| STAPLE OF MIXTURE | = 15.97 | ( S = 16 | W = 1000 ) |
| FINENESS OF MIXTURE | = 4.018 | ( S = 4 | W = 1000 ) |
| COLOUR VALUE A OF MIXTURE | = 1 | ( S = 1 | W = 0 ) |
| COLOUR VALUE B OF MIXTURE | = 3.009 | ( S = 3 | W = 1000 ) |
| PRICE OF MIXTURE | = 2.581 | ( S = 0 | W = 1 ) |
| VALUE OF LOSS FUNCTION | 0.135 | | |

MIXING VECTOR C1

| | | | | | |
|---|---|---|---|---|---|
| 0.3302 | 0.3469 | - 0.0971 | 0.1289 | 0.1333 | 0.1579 |

---------- RESULT OF POST OPTIMISATION ----------

| | | |
|---|---|---|
| STAPLE OF MIXTURE | = 16.44 | ( 16 ) |
| FINENESS OF MIXTURE | = 4.041 | ( 4 ) |
| COLOUR VALUE A OF MIXTURE | = 1 | ( 1 ) |
| COLOUR VALUE B OF MIXTURE | = 3.009 | ( 3 ) |
| PRICE OF MIXTURE | = 2.768 | |
| VALUE OF LOSS FUNCTION | = 0.548 | |

MIXING VECTOR C2

| | | | | | |
|---|---|---|---|---|---|
| 0.5196 | 0.4004 | 0 | 0 | 0.0400 | 0.0400 |

METHOD OF BLENDING TEXTILE FIBERS

The present invention relates to a method of mixing or blending textile fibers in which differing fibers are removed from fiber bales of different origins forming different components and are mixed.

The previous methods of mixing textile fibers comprise either the placement of fiber bales of different origins in a row from which fibers are removed by means of an opening means which travels to and for over the row, so that fiber flocks are removed from the surface and are passed to a transporting means, or the lifting off manually or by machine of parts of fiber bales which are then placed one after the other on a conveyor band of an opening machine in which these parts are opened into fiber flocks and passed to a transport means.

Such transport means can be mechanical or pneumatic and can convey the fiber flocks into so-called mixing boxes in which the delivered fibers are filled as a mixture of flocks.

The mixture of fiber flocks is fed with different speeds from these mixing boxes onto a collective transport device in order to obtain a doubling effect so as to aim at a homogenization of the mixture of fiber flocks. Such homogenizing devices are for example shown and described in German patent specifications Nos. 196 821 and 3 151 063.

The disadvantage of the first named opening and mixing method however lies in the fact that, as a result of the stationary rows of bales, the mixture is invariable until a row of this kind has been fully opened, so that the mixture ratio remains the same during the whole of this time, whereas the second opening and mixing method additionally has the disadvantage of the inaccuracy of the quantity removed.

The object thus arises of generating precise and homogeneous fiber mixtures which can moreover be rapidly changed as required.

It has already been suggested in U.S. Pat. No. 5,025,533 that this object should be satisfied by forming fiber mixing components which each have predetermined different fiber characteristics and which are each mixed with controllable variable component proportions to form a mixture of components. This mixture of components should be respectively determined or corrected in dependence on preset or detected changed characteristics of a subsequent intermediate product, for example of a card sliver or of an end product, for example of a yarn. Through this measure, fibers of different fiber characteristics which can be determined in advance by the taking of samples from the fiber bales can be precisely mixed in order to obtain the desired characteristics of an intermediate product, for example of a card band or of an end product, for example of a yarn.

In other respects the possibility exists, for example through the measurement of fiber characteristics of the card sliver or of the yarn, to determine deviations which make a correction of the mixture possible without delay in order to obtain the desired characteristics of the card sliver or of the yarn.

As already indicated, the fibers of individual fiber bales of different origins have different fiber characteristics. The most important fiber characteristics are for example the thickness of the individual fibers (termed the Micronaire value), the so-called staple (length of the fibers over the range from the shortest to the longest fiber taking account of the percentage proportion of the individual fiber length), the colour in the sense of the basic colour of the fibers (yellow component), the colour based on the contamination of the fibers, the strength (of the individual fibers) and the extensibility of the fibers.

The named fiber characteristics play different roles depending on the intended purpose of the finished yarn, so that in the mixing of the fiber bales, the contributions of the individual components to the characteristics of the mixture or of the yarn manufactured from it must be taken into account.

By way of example, for very fine yarns, which are for example used for ladies' top clothing or for men's shirts, attention must be paid to the fact that the staple is as long as possible, that the degree of fineness of the fibers is high (Micronaire value) and that the fibers have a high strength. Further important parameters are the colors of the fibers of the individual origins which determine the appearance of the yarn. The extensibility of the fibers of individual origins likewise plays an important role since it influences the subsequent weaving process. On the contrary, for yarns which are to be processed into jeans material, the staple length plays a substantially smaller role in contrast to the fine yarns and it is important for these yarns that dust is fully removed because otherwise contamination of rotor grooves can occur.

If now a deviation of the characteristics of the card sliver or yarn is found for a specific fiber mixture with several components then this can under circumstances be regulated out by various different changes of the fiber mixture. This fact leads to difficulties, both with the creation of the regulation program and also in fact that various possible changes do not meet the aims of the management of the spinning mill. By way of example, an automatic regulation system could lead to the consumption of one specific component being too high, although the supplies of this component are not sufficient. As a further example, it would also be conceivable that the regulating system would cause the increased supply of a certain relatively expensive component, although the same effect could also be achieved by the supply of a less expensive component.

Finally, it can be seen from these examples that the task of generating precise and homogeneous fiber mixtures, which can also be rapidly changed if required, can also be understood in such a way that the management of the spinning mill should be placed in the position of being able to determine the fiber mixtures to be produced in a manner which is as simple as possible and, if required, to set priorities in the regulation procedure.

In order to solve this more specific task it is proposed, starting from the initially named method that I) at least the following statements or data are fed into a regulation system:
   a) the initially roughly estimated desired quantitative component distribution, i.e. proportions of the different components,
   b) the characteristics of the fibers of the individual components, and
   c) the desired characteristics of the card sliver or yarn manufactured from the fiber mixture;

II) in that the regulating system calculates from these given statements, in accordance with a given regulation algorithm, a component distribution which comes close to the given component distribution and which satisfies the card sliver or yarn characteristics, and in that on system so controls the operation of a III) the regulative mixer which mixes the individual components that the computed distribution of components is obtained in the fiber mixture delivered by the mixer.

Through this method, the management of the spinning mill has the possibility of being able to select the quantitative component distribution in accordance with the stocks in hand (bales in store) and also in accordance with the customers' wishes, with both the characteristics of the fibers of the individual components and also the desired characteristics of the product manufactured from the fiber mixture being taken into account during the specification of the mixture. The characteristics of the fibers of the individual components can be determined by laboratory investigations of the individual fiber bales or on-line. It is also possible to provide each fiber bale with a coding which recites the characteristics of the material contained therein.

Through these given statements, the regulation algorithm is, on the one hand, simplified and, on the other hand, one also succeeds in selecting the regulating algorithm such that a concrete mathematical solution can be reliably found for the component distribution which comes closest to the given (desired) component distribution and thus satisfies the wishes of the management of the spinning mill.

The so described method can also be executed in such a way that with the feature I) one additionally sets at least one regulation priority d) in the sense that the maintenance of at least one component proportion or a card sliver or yarn characteristic has precedence. In this method, the management of the spinning mill has, for example, the possibility of ensuring that the yarn that is produced contains at least a certain percentage of a favorably priced fiber component or has a contamination content which does not exceed the predetermined limiting value.

The method can then be straightforwardly executed in such a way that a weighting is given for each listed regulation priority. This weighting can also take place via the sequence of the statements.

When carrying out the method at least some of the desired card or yarn characteristics can be measured during manufacture of the card sliver or yarn and divulged to the regulating system. In the event of deviations with respect to the measured characteristics having regard to the desired values, the regulating system then computes the component distribution anew. In this way, the fluctuations in the characteristics of the fibers of the individual components can be taken into account. It can for example readily occur that the samples taken from specific fiber bales are nevertheless not representative for the characteristics of the entire bale. Through the procedure in accordance with the invention such occurrences are also taken into account.

One can also additionally measure further card sliver or yarn characteristics in the laboratory and, in the event of disturbing deviations, likewise feed these into the regulating system, whereby these deviations are also taken into account in the new computation of the component distribution. In order to preclude undesired fluctuations of the regulation process, the characteristics measured during the manufacture of the card sliver or yarn should first be taken into account by the regulation system after an appropriate average value has been formed. The computation of the component distribution preferably takes place in accordance with the principle of minimum deviations or minimum weighted deviations from the desired value statement.

A possibility of realizing this lies in computing the component distribution in accordance with the principle of minimum quadratic deviations or minimum weighted quadratic deviations from the desired value statement. A further possibility of the computation of the component distribution takes place in accordance with the following equation or the following regulating algorithm in that the quality criteria $$J(u) = \int_{o}^{\infty} \{x^T(t)\, Q\, x(t) + u^T(t)\, R\, u(t)\} dt$$

is minimized, where x(t) recites the regulation deviations in the form of a vector, i.e. The deviations of the measured characteristics from the desired characteristics, $x^T(t)$ is the transform of x (t)

u(t) is the control vector which recites the desired component distribution, $u^T(t)$ is the transform of u(t), matrixes with which the Q and RO are matrixes with which the individual components in x(t) and u(t) are weighted.

The regulation can also simultaneously be used for the adjustment of a coarse cleaning unit which is inserted between a bale opening machine and the mixer, with the adjustment of the coarse cleaning unit influencing the card sliver or yarn characteristics and hereby also the computation of the component distribution.

A coarse cleaning unit, or indeed a fine cleaning unit can also lead to a falsification of the mixture which can only be taken into account when the regulating system takes account of the action of the cleaning unit.

By way of example, it can be necessary with a contaminated starting component to carry out a very intensive coarse cleaning, whereby relative many of the short staple fibers are also separated out, so that the staple of the final product if anything tends to be too long with regard to the required characteristics. Under these circumstances it would be sensible for cost reasons to increase the proportion in the mixture of a relative short staple, more favorably priced component.

In order to take account of such circumstances the invention thus proposes that the regulation system takes account of the adjustment of the existing cleaning unit or of the cleaning units during the calculation of the component distribution.

If, for example, an intensive fine cleaning is carried out then staple shortening must be expected, so that a change of the component mixture is appropriate in order to obtain the desired staple in the card sliver.

Even if the regulating system does not influence the adjustment of the fine cleaning unit then it should at least receive information concerning the setting of the fine cleaning unit in order, in this manner, to effect the computation of the component distribution in a manner appropriate to the method.

A further advantage of the method of the invention makes itself notable in the change of the material being produced. Here the method of the invention envisages that the regulation system coordinates the new adjustment of the component distribution and the change of a can at the output of the card so that the transition from one material mixture to the next takes place without notable interruption and with minimum loss of product.

By way of example, when initiating a change of material, a change of can at the card outlet can be carried out directly on initiating this change of material or shortly thereafter, and indeed at a time at which one is still certain that the card sliver which is being produced still has the desired characteristics of the previous type of material. A can is now inserted which receives the card sliver until card sliver with the desired characteristics of the new material is received at the card outlet. As soon as this has occurred, the regulating system causes a further can change, with the new can receiving the card sliver of the new type of material.

The card sliver produced during the change of material type can be used again as a mixture component, i.e. can be supplied again to the mixer. If this takes place in small percentages then it does not lead to any notable falsification of the desired product, particularly since the regulating system is in a position of maintaining the characteristics of the product within the selected tolerances.

According to the invention, a further solution of the more specific task in a method of the initially named kind is characterized in that:

I) at least the following statements or data are fed into a computer:
   a) the characteristics of the fibers of the individual components and
   b) the desired characteristics of the card sliver or yarn manufactured from the fiber mixture or alternatively the desired characteristics of the fiber mixture;

II) the computer calculates from these statements in accordance with a predetermined computing algorithm a component distribution which, with minimized deviation from the desired card sliver or yarn characteristics, at least approximately satisfies these characteristics, and optionally effects a correction of the computed component distribution taking account of any boundary conditions or special wishes which have been fed into the computer, and thereby calculates a corrected component distribution, III) the component distribution, or the corrected component distribution, found by the computer, is used for the adjustment or regulation of the supply of individual components to the mixer in order to obtain the calculated and optionally corrected component distribution in the fiber mixture delivered by the mixture.

This solution in accordance with the invention is of particular importance because it takes account of the purchase prices of the fiber components (which forms one of the characteristics of the fibers of the individual components) and produces a fiber mixture the price of which lies at a minimum. Variants of this method may place the management of the spinning mill in the position of being able to play through by way of computation or simulation, the effects of different wishes or desires, and shows in a transparent manner whether the realization of these wishes is associated with particular disadvantages, for example whether the realization lies too far away from an ideal production.

Use may also be made of a refined cost figure which is determined after removal of contamination from the purchased material since it recognizes that the true cost of the material differs from the purchase price. For example if material a) costs 1 Dollar per kilogram but contains 7% of contamination (dust, shell parts etc.) then its real price is 1 Dollar for 930 g equals 1.075 Dollars per kilogram. A second component having a purchase price of 1.05 Dollars per kilogram but containing only 2 g of contamination in fact has a true price of 1.071 Dollars per kilogram and is actually less expensive than the first named component in real terms, although a direct comparison of the purchase prices would suggest otherwise. Since the program of the present invention used to calculate the ideal mixtures includes the price of the individual components as a basic statement and indeed minimizes the total price of the fiber mixture as a step in the optimization process, it is preferable not to use the straightforward purchase prices for the material but rather corrected values which take account of the contamination of the material. If the contamination forms a separate input parameter, since it is also a characteristic of each component, then the step of deriving the corrected prices can be carried out by the computer prior to computing the optimum component distribution.

The present invention also embraces apparatus for carrying out the above listed and explained methods, in particular using a computer for carrying out the regulation.

The invention will now be explained in more detail with reference to drawings which simply illustrate ways of executing it, with FIGS. 1 to 10 showing various possibilities for the construction of a plant for the opening of bales of fibers, and for the mixing of fibers of different origins, and reproducing U.S. Pat. No. 5,025,533, whereas FIGS. 11 to 14 and also the tables of FIGS. 16 to 20 show different variants of the regulation method of the present invention. Stated more precisely FIG. 1 schematically illustrates an arrangement employing a method of blending textile fibers in accordance with the invention;

Figure 8:
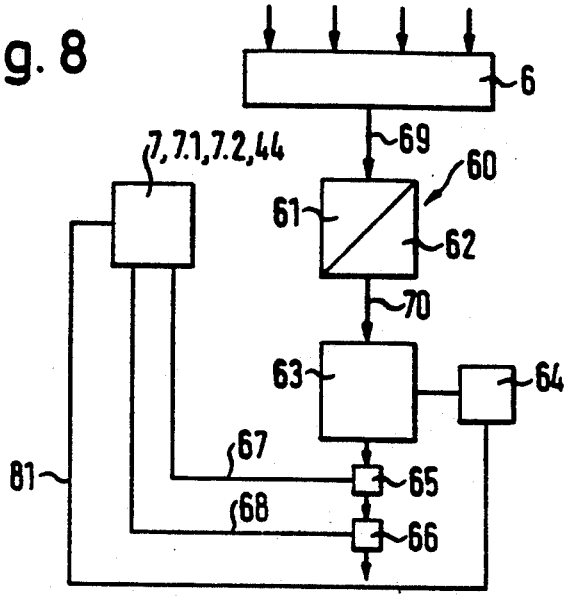
Figure 9:
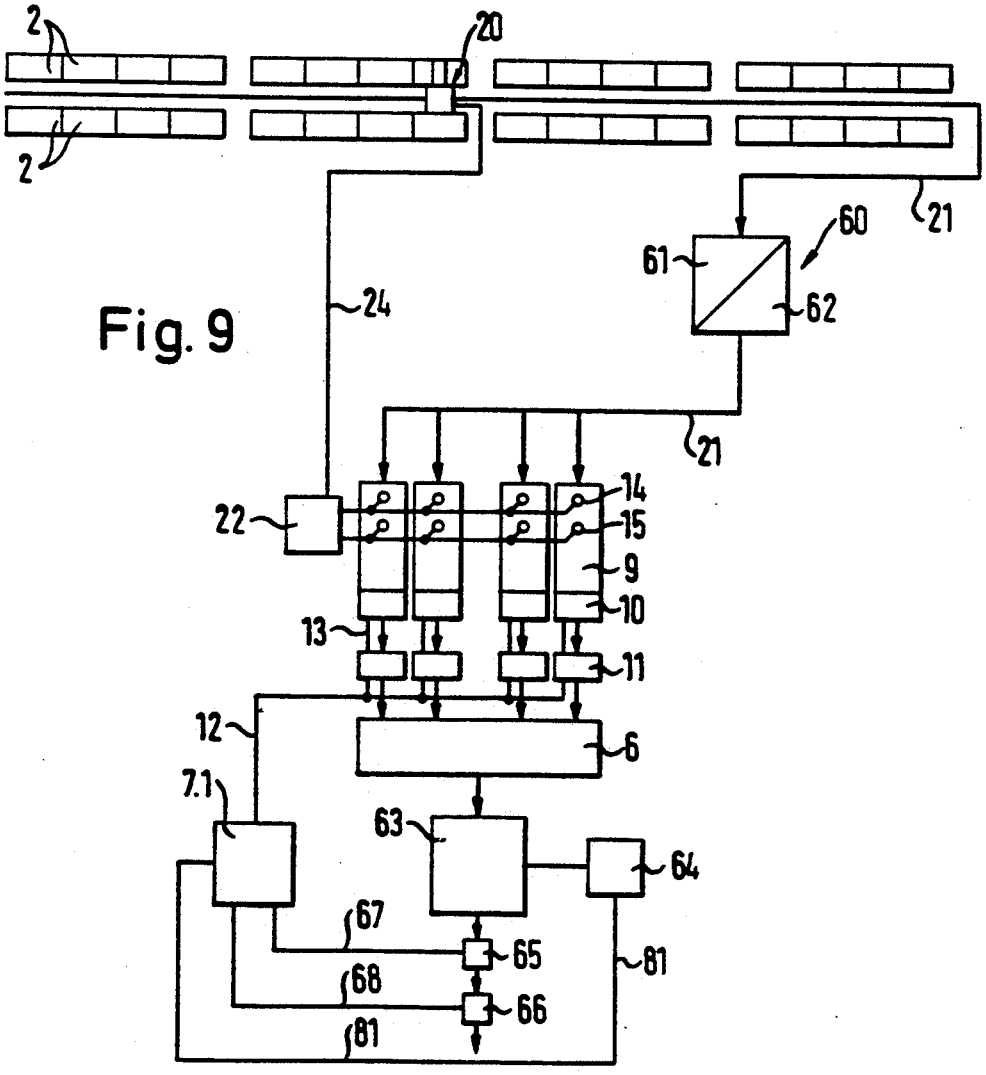
Figure 10:
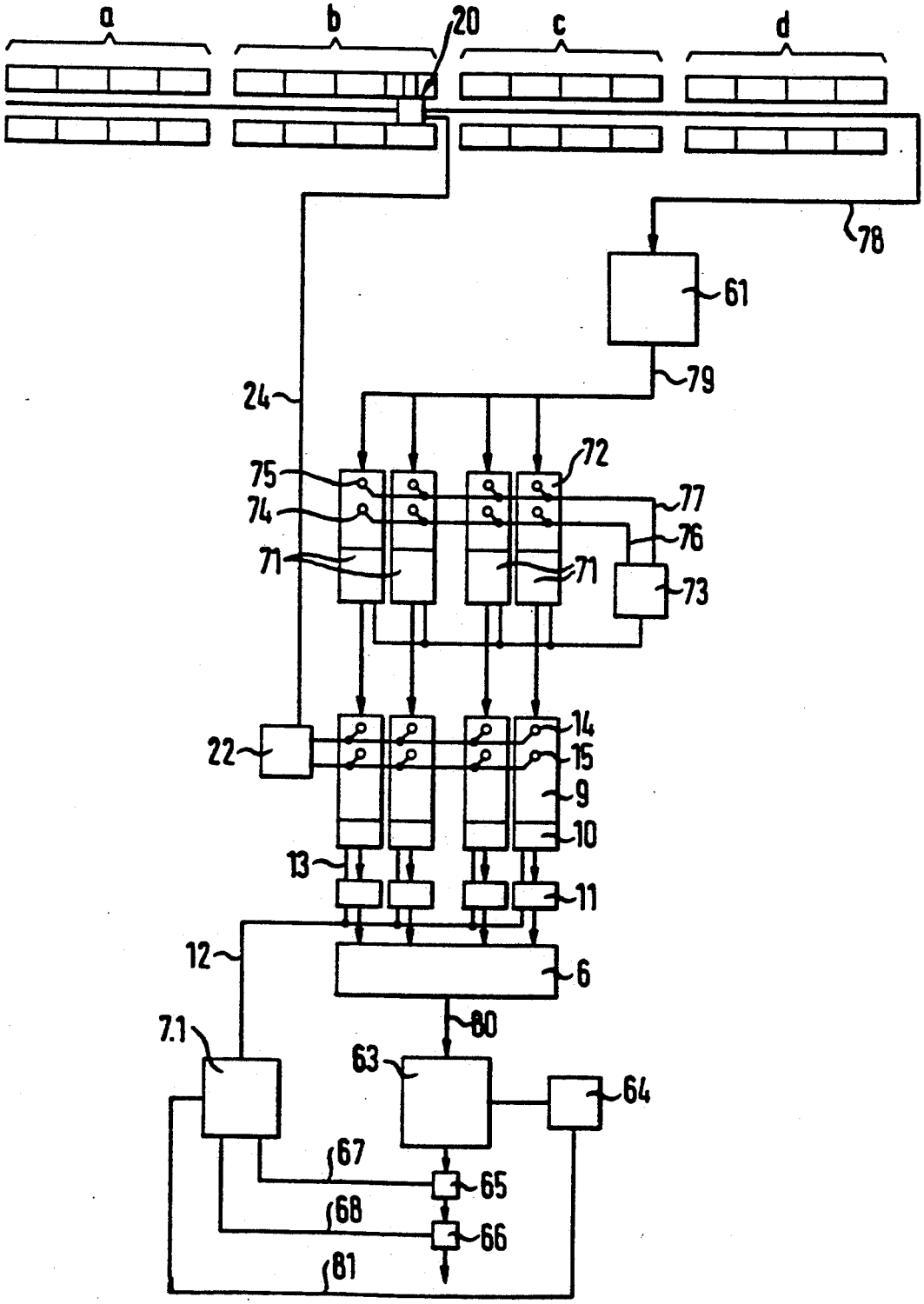

FIG. 8 schematically illustrates an arrangement for the measurement of the characteristics of a cad sliver produced from a fiber blend in accordance with the invention;

FIG. 9 illustrates an overall arrangement for producing a card sliver from a plurality of fiber bales in accordance with the invention; and FIG. 10 illustrates a further modified system in accordance with the invention.

Figure 2:
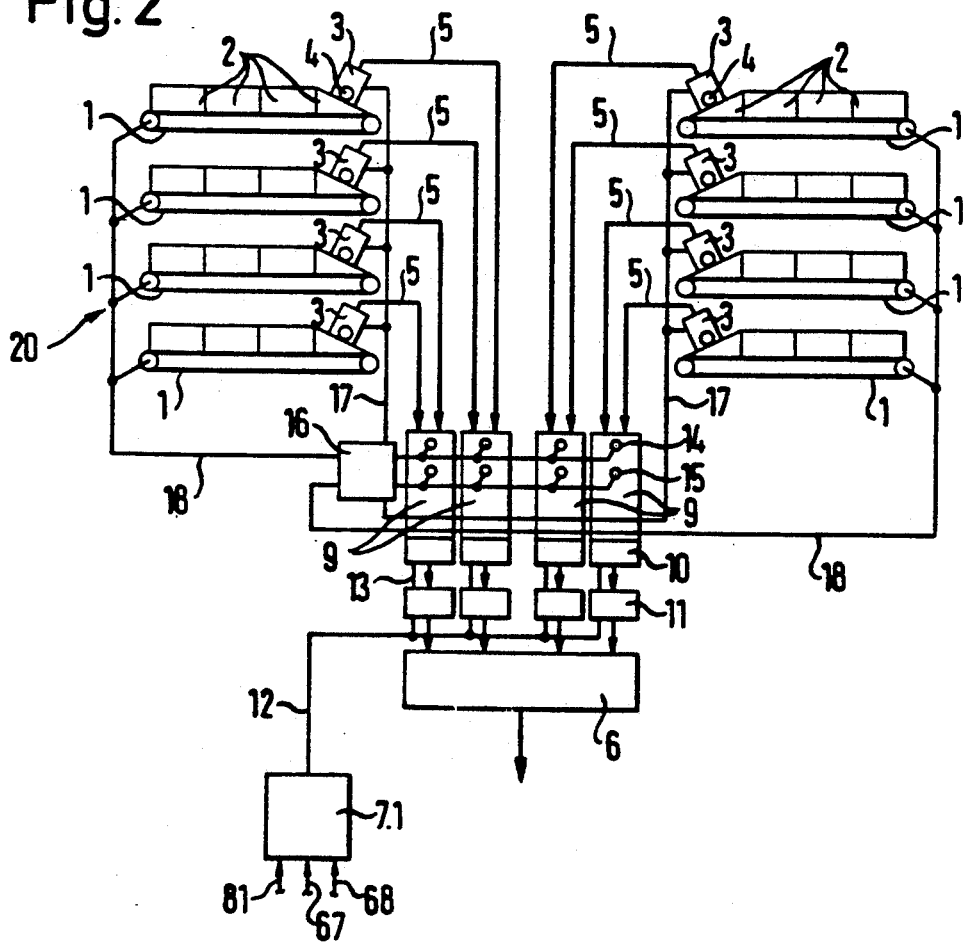
FIG. 2 illustrates a modified arrangement employing a method in accordance with the invention.
Figure 3:
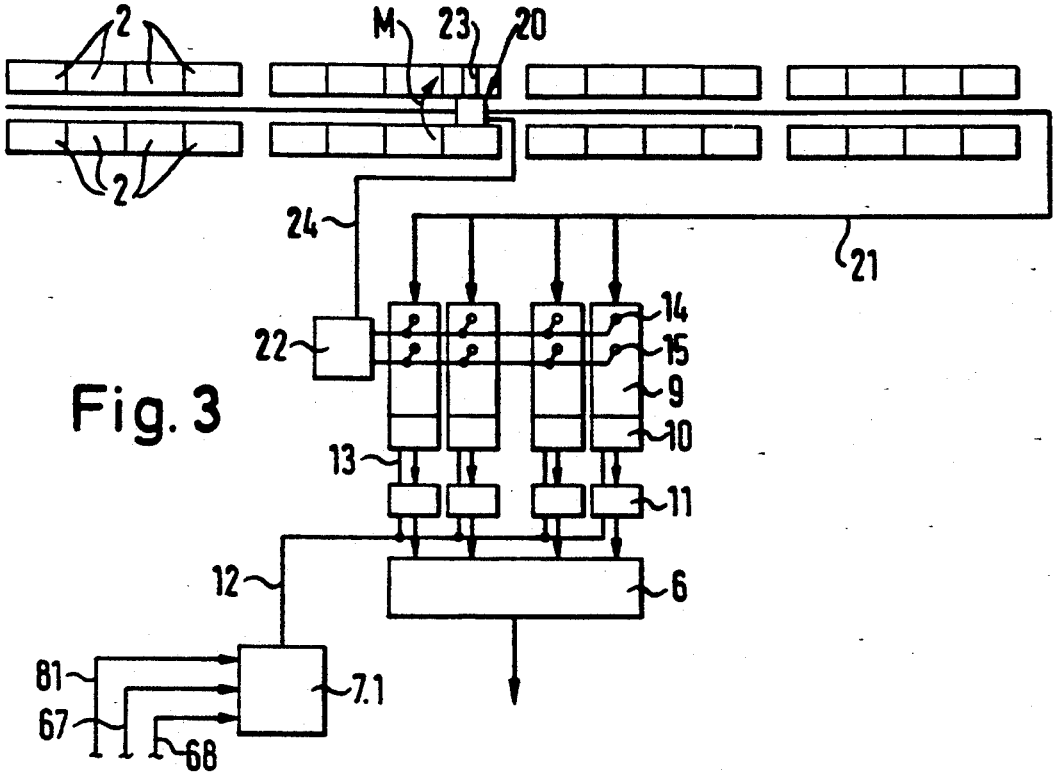
FIG. 3 illustrates a modified arrangement employing a single travelling extraction device for the blending of fibers in accordance with the invention.
Figure 5:
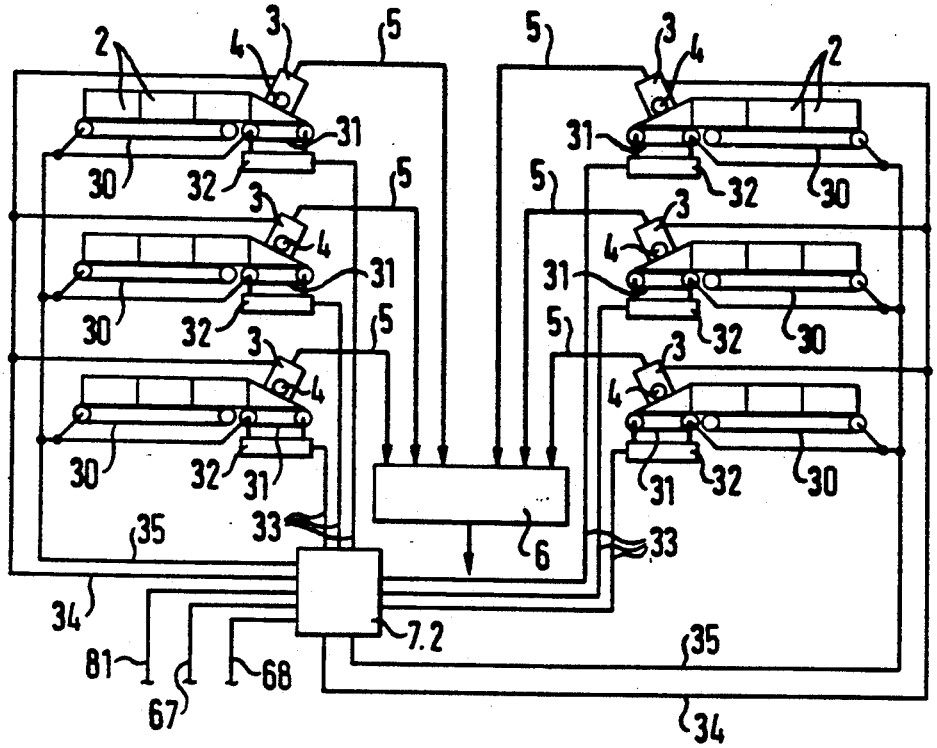
FIG. 5 illustrates a further modified arrangement employing a weighing device in accordance with the invention.
Figure 12:
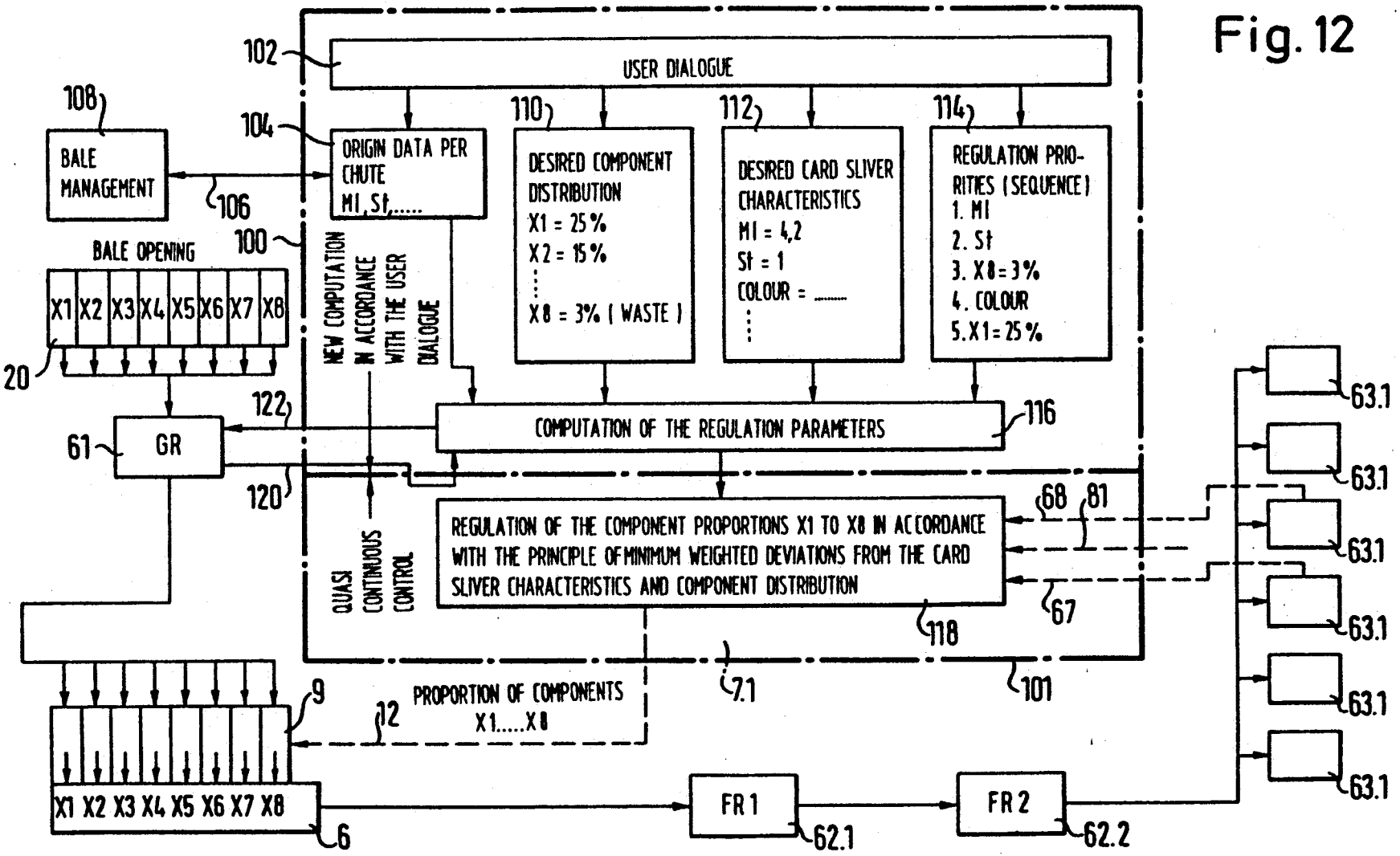
Figure 13:
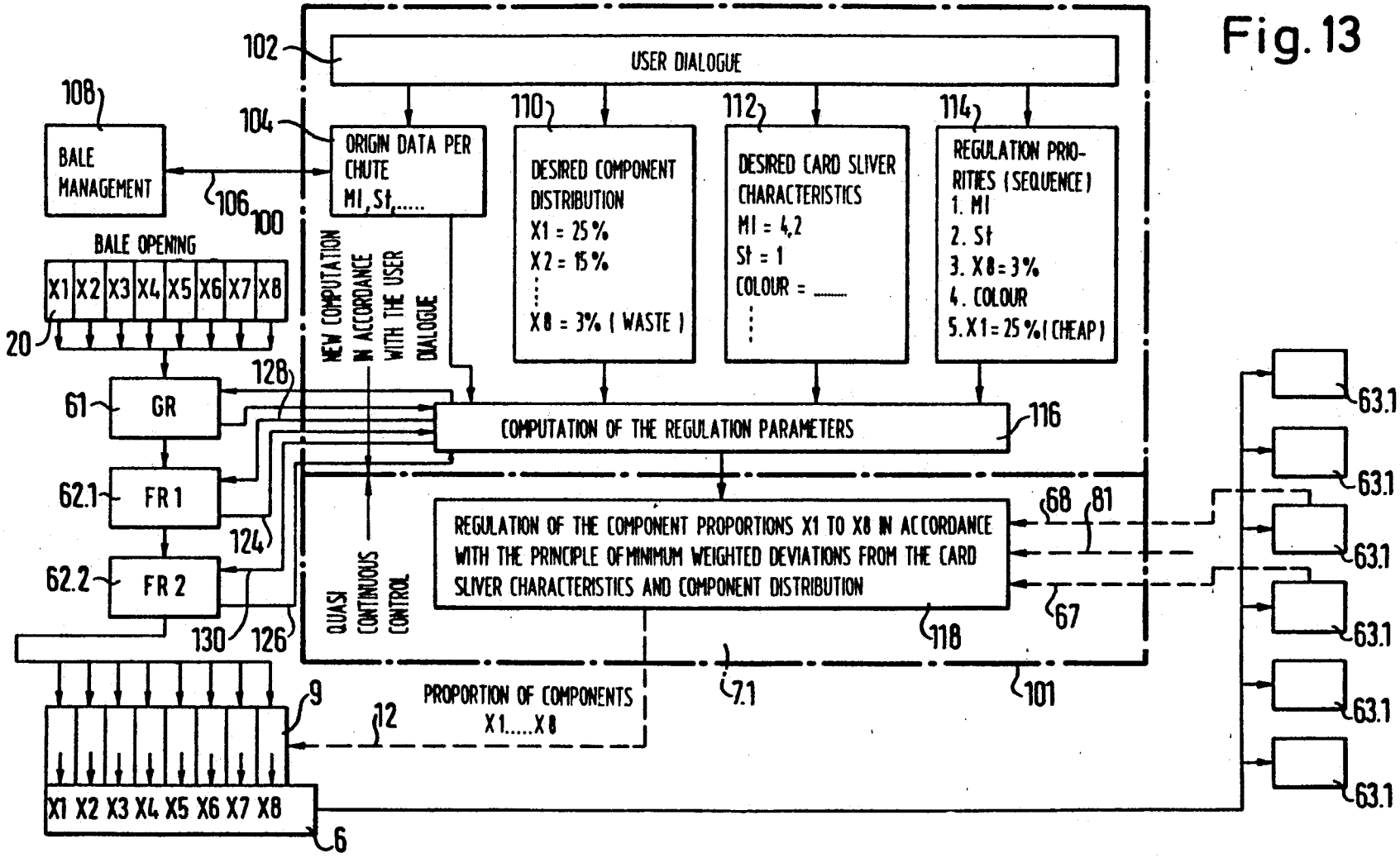
Figure 14:
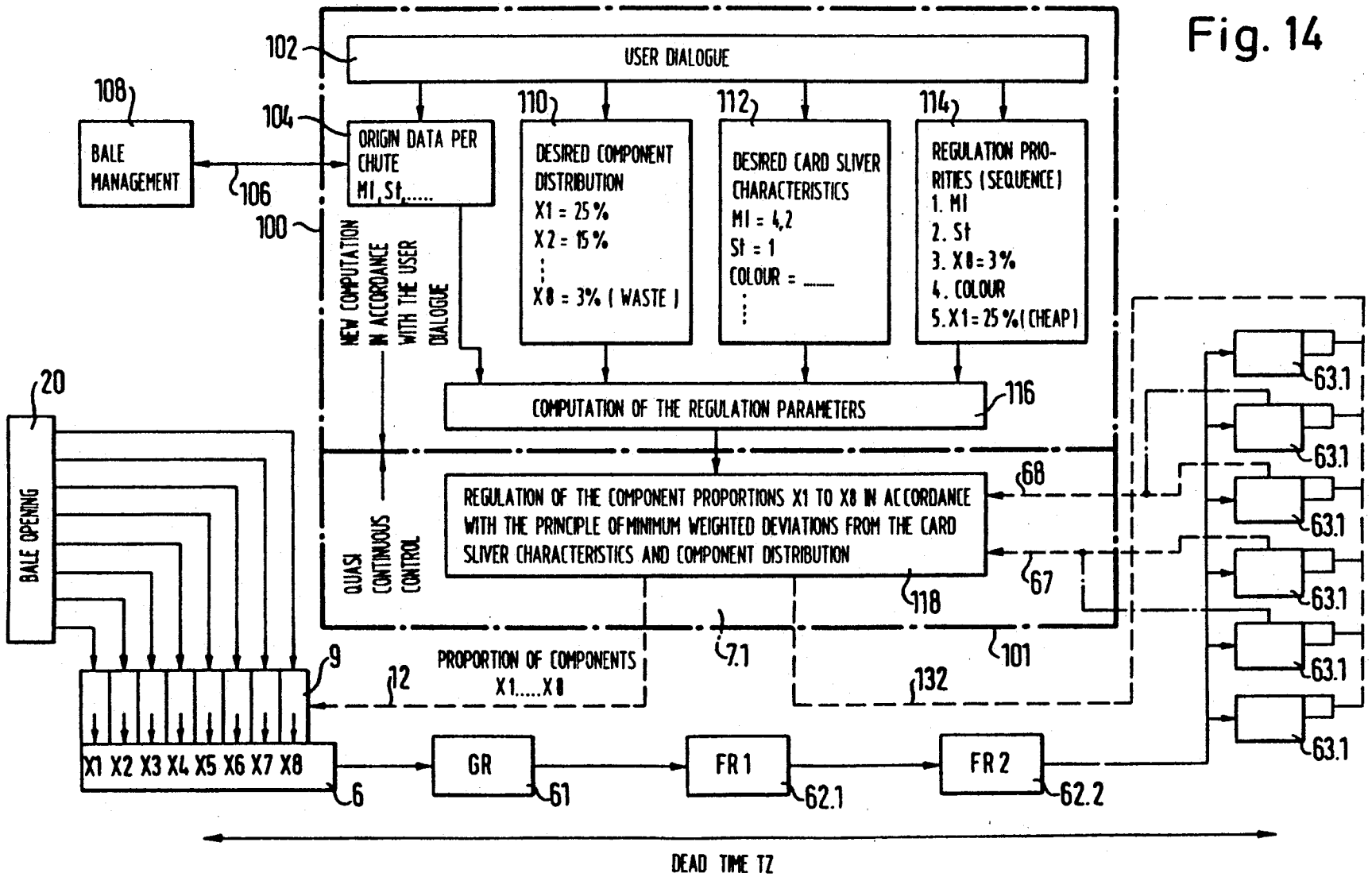

FIG. 11 shows a schematic diagram which serves to more precisely explain the regulating method, and indeed with an embodiment in accordance with FIG. 2, with controllable metering apparatus being provided at the output of each component cell, with the same regulation process also being used for the embodiments of FIGS. 3 and 5 and also being usable with certain modifications for the other embodiments, FIG. 12 shows a further schematic diagram similar to FIG. 11 however for the regulation method with an embodiment similar to FIG. 9 with a coarse cleaning unit arranged between the bale opening machine and the mixer, and also with the special feature that two fine cleaning units are provided which, in contrast to FIG. 9, are arranged after the mixer, FIG. 13 is a schematic diagram which is similar to FIG. 12 but is more precisely directed to the embodiment of FIG. 9, with two fine cleaning units being provided and arranged directly after the coarse cleaning unit, FIG. 14 is a further schematic diagram similar to FIG. 11 in which however the regulation is laid out to coordinate the can change at the outlet of the card with a change of the type of material, and FIGS. 15 and 16 are tables illustrating the computation of the desired component distribution.

Figure 1:
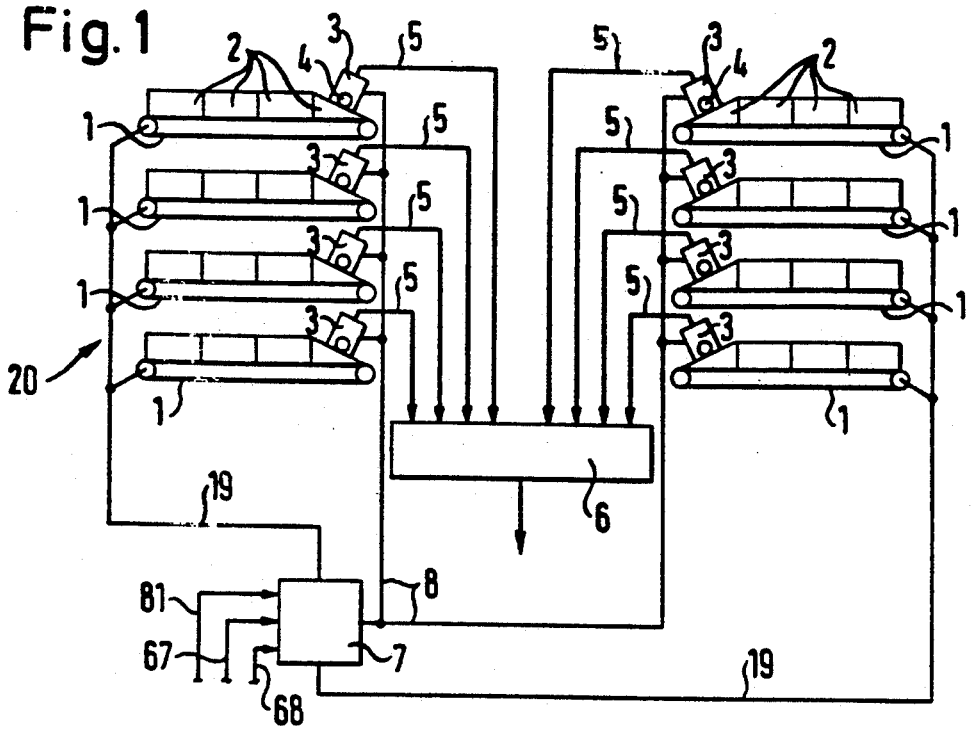

FIG. 1 shows a number of conveyor belts for the acceptance of fiber bales 2, which are opened by fiber-bale organs 3.

In this figure, the fiber-bale organ in question moves on stationary rails which, for example, are arranged in a direction diagonal to the fiber-bales 2 located on the conveyor belt. A device of this type, designated here with the reference symbol 20, is known basically from the Swiss Patent Application 503809. As a variant to this, the device described and shown in Swiss Patent Application applicant, indicated with the No. 0039/88-8, could also be used, with which the opening organ 3 on the opening device (not shown) moves to and for on horizontal rails along the -bales- 2 with an upwards and downwards movement as well as providing an adjustable inclination for oblique opening.

The opening performance of the two opening devices can be controlled by alteration of the speed of movement along the aforesaid diagonal path of the fiber bale opening organ 3, as well as by the variable speed of advance of the fiber-bales 2 through the variable speed of the individual conveyor belt 1.

The fiber-flocks opened by the opening drum 4 are transported away by a pneumatic conveyor pipe or duct 5 in a known way, which is not further described here.

The fiber-flocks are conveyed to a blender or mixer 6 with the aid of this pneumatic conveyor pipe 5 and blended therein to an even blend.

The quantities transported with the help of these individual pneumatic conveyor pipes 5 to the blender 6 are designated in the following as fiber-flock components or simply as components.

Batch mixers or continuous mixers can be used as mixers; each according to the circumstances, the aforesaid quantities are individual weight charges (kgs) or a continuous quantity per unit of time (kgs/hr).

For the sake of simplicity, the conveyor pipes 5 in FIG. 1 discharge into the likewise schematically shown blender 6, which, however, in practice can be different according to the type of blender. For example, air-fiber dividing devices can be used in order to separate the particular fiber air blend from each other, so that the fiber flocks can fall freely into the blender, during which the air can be conducted into an exhaust air duct. Such separation devices are well known in practice and are not drawn in detail for this reason.

The aforesaid quantities of the previously mentioned individual fiber flocks components given into the blender 6 are controlled through the control unit 7, on the basis of a control program.

A control program of this type can be a computer program which has a component blending program, which is adjustable or alterable to suit the alterations in the blend.

Another variant could consist of one digital control unit per component, with which the amount of the individual components could be selected or altered manually.

Thereby, the decisive functions for the opening performance of the components, as for example the feeding speed of the particular conveyor belt 1 or the opening movement of the fiber bale opening organ 3, are controlled by one or the other control unit.

It is clear that the pneumatic conveyor pipes do not have to convey the opened product directly into the blender but rather mechanical elements can be inserted therebetween, for example, conveyor belts. In such cases, the aforesaid fiber air dividing devices pass their fiber product into such mechanical conveying elements.

Each fiber opening organ 3 is connected by a control lead 8 to the control unit 7 and each conveyor belt 1 is connected to the control unit 7 by a control lead 19.

The three control leads entering into the control unit 7 are described later.

FIG. 2 shows a variant to FIG. 1, in which, however, the same elements have the same reference symbols. Therein, the pneumatic conveyor pipes 5 do not convey the opened fibers or fiber flocks, also called product, directly into the blender 6, but rather into the component cells 9 from which the product filled therein is opened with an appropriate delivery apparatus 10 and passed to a blender 6 by means of a subsequent metering apparatus 11.

Depending on the type, the delivery apparatus 10 can likewise take over the metering function, as a variant.

The discharge output from the individual component cells 9 is controlled through a control unit 7.1, which by means of control leads 12, regulates the individual material apparatus 11 or regulates the delivery apparatus 10 as a variant.

In the first named disposition, the metering apparatus 11 can be controlled via the delivery apparatus 10, in order to co-ordinate the delivery with the metering. The delivery apparatus, however, can also be controlled directly from the control unit 7.1.

The component cells 9, which can also be formed according to the German Patent Application P 39 13 997.2, are filled with the elements 1 to 5 as already explained in FIG. 1, whereby the use of two rows of fiber-bales, each with the elements 1 to 4, is only selected as an example. In practice, several rows of fiber bales can be selected, or only a single row per component cell 9. This decision depends on the number of different types of fiber or blend of fibers of different origins per row of bales which should form the component blend to be fed into the appropriate cell 9.

Further, the filling of the component cells 9, is controlled, for example, by the provision of full indicators 14 and empty indicators 15 in every cell.

For this purpose, the control unit 16 for the reciprocating motion of the opening organ 16 is connected with the fiber bale opening organ 3 through the control leads 17 and connected through the control leads 18 with the driving motor for the conveyor belts 1.

FIG. 3 shows a further embodiment in which the elements already described and shown in FIG. 2 are designated with the same reference symbols. This applies to the fiber bales 2, the component cells 9, the delivery apparatus 10, the metering apparatus 11, the blender 6 as well as to the control unit 7.1 and the control leads 12 and 13.

For the opening of the fiber bales 2, which stand directly on the floor in this case, these are likewise placed in groups which correspond to the origins of the fiber bales. The opening results through a movable fiber bale opening device 20 which moves along the fiber bale groups and opens fibers or fiber flocks from the surface. A device of this type is already known in the spinning trade under the name of "Unifloc" and is sold all over the world.

The fiber bale opening device 20 conveys the opened fibers in the normal way via a conveyor pipe 21 into the appropriate component cells 9.

As already described for FIG. 2 the component cells 9 have full indicators 14 and empty indicators 15 which transmit their signals to a control unit 22.

This control unit is connected via a control lead 24 with the fiber bale opening device 20 and controls the opening of the fiber flocks from the appropriate fiber bale group for filling the appropriate component cells.

As shown schematically in FIG. 3, the fiber bale opening device 20 has a well known Unifloc fiber opening organ 23, which opens the fibers by means of an internal rotating drum (not shown) from the surface of the bales.

Likewise, it is well known that the fiber bale opening organ 22 can be turned through 180°, as designated by the arrow M, in such a way that the fiber bale opening organ of the fiber bale group 2 can open on the opposite side. This makes it possible that either one of the oppositely disposed fiber bale groups can be used as a reserve fiber bale group, or that, with the aforesaid possibility of the automatic rotation of the fiber bale opening device 20, both of the fiber bale rows lying opposite to each other can be opened with a specified alternation.

Figure 4:
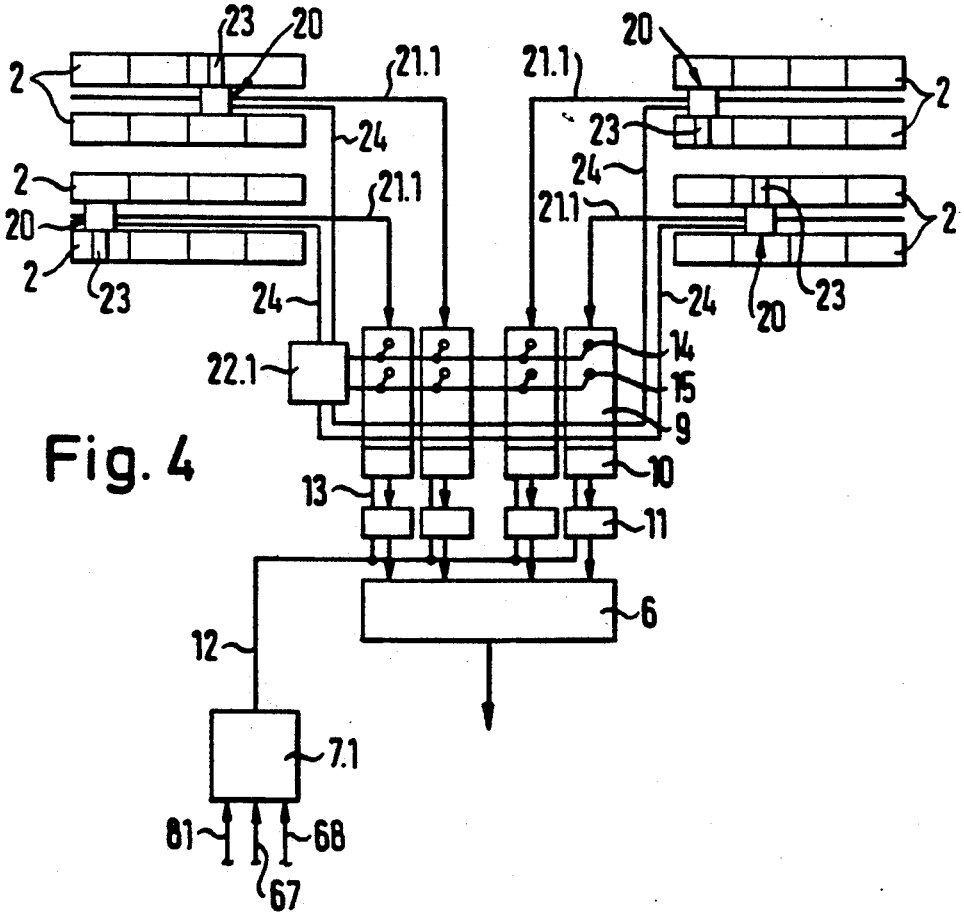
FIG. 4 illustrates a further modified arrangement employing a plurality of travelling extraction devices in accordance with the invention.

FIG. 4 shows a variant of FIG. 3, so that the elements already shown and described for FIG. 3 have the same reference symbols.

The difference between what is shown in FIG. 3 and FIG. 4 is not only that a single fiber bale opening device 20 is provided, but rather that one fiber bale opening machine is provided for each of the total of four fiber bale groups arranged in two rows opposite to each other. Correspondingly, the control unit is designated with 22.1 instead of with 22, as four individual fiber bale opening devices can each be separately controlled with this via the appropriate control lead 24. Likewise, one pneumatic conveyor pipe is provided for each fiber bale opening device 20, which is accordingly designated with 21.1 instead of 21 and each of which discharges into a component cell 9.

FIG. 5 shows an arrangement similar to FIG. 1 in which instead of the individual conveyor belt 1 for each group of fiber bales of FIG. 1, each group of bales is provided with a conveyor belt 30 with a purely conveying function and with a conveyor belt 31 with a conveying/weighing function per fiber bale group.

The weighing function of the last mentioned conveyor belt can, for example, be provided through the fact that the axes of the deflection rollers of the conveyor belt 31 are supported on known pressure cells 32, which give a signal 33 corresponding to the weight, which, in each case, is passed on over a control lead 33 to a signal processing control unit 7.2. The processing of the aforesaid signals consists of the fact that the control unit 7.2 processes the control signals received which control the motors of the aforesaid conveyor belts 30 and 31 over the control leads 35 and control the opening organ 3 over the control leads 34.

Naturally, other systems can also be used, which can be combined with conveyor belts.

Further, the elements already described and shown for FIG. 1 are designated with the same reference symbols.

In operation, the control unit 7.2 controls the fiber opening organ 3 as well as the conveyor belts 30 and 31, in order to open the fibers from the fiber bales 2 at specified speeds, which are then conveyed by means of pneumatic conveyor pipes 5 into the blender 6.

Thereby, every fiber bale opening organ 3 of the individual fiber bale groups each conveys a specified quantity, controlled from the control unit 7.2, into the blender 6. This specified quantity to be opened (kps/hr) per bale group is monitored by the appropriate weighing conveyor belt 31 respectively through the pressure - weighing device 31, is converted into signals and is transmitted to the control unit via the control leads 33. If the quantity opened per fiber bale group (kps/hr) does not agree with the predetermined quantity, then the control unit adapts the quantity opened until it agrees with the predetermined quantity.

Thereby, the measuring device 32 always measures when the fiber bale opening organ stops for an instant on the reversing point of the reciprocating movement path.

In this type of opening, the fiber bale opening organ 3 always moves to and for and upwards and downwards over the same path, substantially lying along the diagonal of the fiber bale to be opened. The quantity (kps/hr) of the fiber flocks to be opened is generated by the speed of advance of the conveyor belts 30 and 31 and of the opening organ 3.

The control unit 7.2 can be an electronic control unit on the basis of analog technology or a microprocessor, by means of which the different opening quantities of each bale group are set and adapted through the signals of the control unit leads 33 as well as the input signals, which will be explained later.

Figure 6:
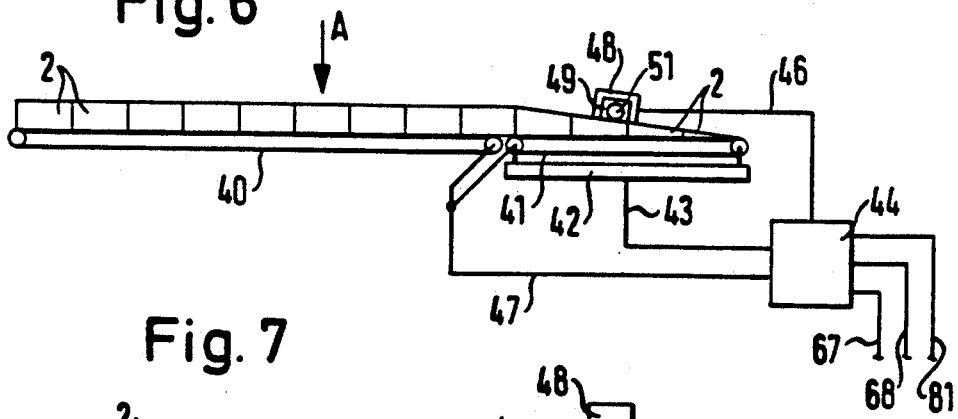
FIG. 6 illustrates a modified weighing system in accordance with the invention.
Figure 7:
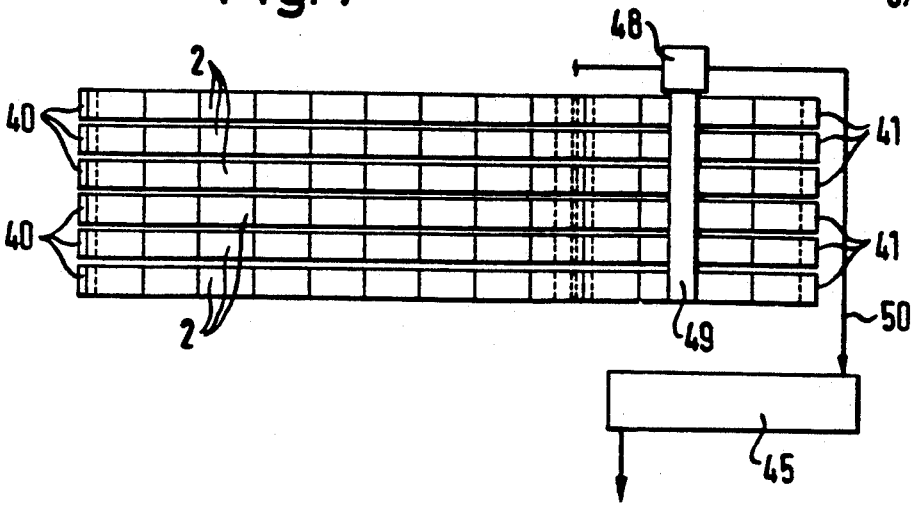
FIG. 7 illustrates a top view of the arrangement of FIG. 6.

The FIGS. 6 and 7 show a similar weighing system as FIG. 5, whereby FIG. 7 is a top view of FIG. 6, corresponding to the direction of the arrow A.

It can be seen from FIG. 7 that it is a matter of a number of rows of fiber bales respectively bale groups, which are arranged next to each other, each of which form a blend component. The fiber bales 2 lie as shown in FIG. 6, each bale on a conveyor belt 40 connecting to weighing conveyor belt 41. Thereby, every weighing conveyor belt 41 is supported on pressure elements 42 analog to the weighing conveyor belt 31 in FIG. 5, from which a signal corresponding to the weight is transmitted by means of a control unit lead 43 to a control unit 44.

The fiber bales 2 on the weighing conveyor belt 41 are opened through the fiber bale opening device 48 according to the Swiss Patent Application No. 00399/88-8 which has already been mentioned in connection with FIG. 1. The difference mainly exists in a long opening organ 49 with an opening drum 51, extending over the specified number of bale rows, which, above all, opens fibers from the specified rows of bales, as shown in FIG. 7.

A further difference of this type of opening as opposed to that described for FIG. 1 consists in the fact that the fiber opening organ 49 opens in an inclined opening path, which corresponds substantially to the diagonal of a predetermined number of fiber bales 2 arranged next to each other, for example 4 fiber bales, as shown in FIGS. 6 and 7.

It is clear, however, that a different number of bales can be opened obliquely in this way, for example, one row only, as shown in FIGS. 1 and 2.

Likewise, the number of fiber bales arranged next to each other which can be opened simultaneously depends on the possible length of the opening organ 49.

The fiber material opened by the fiber opening organ 49 is conveyed in a pneumatic conveyor pipe 50, which discharges in a continuous blender 45 according to the invention. As described for FIG. 1 the conveyor pipe 59 can discharge into a separating device (not shown), which feeds the product into the blender 45.

Furthermore, the speed of the fiber bale opening device 48 is controlled through the control unit 44 via the control lead 46.

A further control lead 47 serves for the control of the driving motors of the deflection rollers for the control belts 40 and 41.

It is clear, that the deflection rollers for the conveyor belts 41 and 42 (not specially designated) of each bale group have a separate driving motor, that is, every motor has a separate control lead 41 to the control unit 47.

In operation, the control unit 44 controls the reciprocating movement of the fiber bale opening device 48 along the bales located on the weighing conveyor belt 41 and the upwards and downwards movement of the fiber bale opening device 49 on the device 48 during the aforesaid reciprocating motion, so that the fiber bales, as shown in FIG. 6, are opened in an inclined position corresponding substantially to the direction of the diagonals of the four bales 2.

This opening movement always runs on the same path and with a predetermined speed, so that the opened quantity (kps/hr) of the individual fiber bale groups can be differently selected through the feeding speed of the conveyors 40 and 41. These different feeding speeds of the individual groups of bales correspond to an opening program with different quantities to be opened (kgs/hr) of the individual bale groups, in order to maintain the said blend.

It is an advantage when the driving motors for the conveyor belts 40 and 41 are drum motors, which are built into the deflection rollers for belts. Such drum motors can be operated with different frequencies by means of frequency inverters, that is with different rotational speeds, which is a component of the control unit 44.

Likewise, the control unit 44 which has been mentioned in all cases in this application and particularly in FIG. 5, can be an analog or digital control, by means of which the quantities of the individual components are controlled. When these quantities do not correspond to the nominal, they are then corrected by means of the pressure element measuring signals which are transmitted to the control unit 44 by means of the control lead 43.

FIG. 8 shows an extension of the method up to now, in that after the blender 6, the product coming from this blender is passed to a so-called cleaning section 60, in which well known cleaning machines are used.

The cleaning section 60 can contain so-called coarse cleaning machines 61 and fine cleaning machines 62. This cleaning section is only shown schematically, as hitherto.

What has been said for the cleaning section also applies to the subsequent card 63, which can be the well known card C4, for example, which is sold by the applicant worldwide.

This card 63 is provided with a well known carding function control unit 64, which, amongst other functions, also has to ensure the evenness and the quantity (kps/hr) of the carded sliver.

After the carding machine, seen in the direction of travel of the sliver, in front of the carded sliver delivery, which is not shown, the carded sliver is checked by a colour sensor 65 and by a sensor which measures the fiber fineness 66.

At the outset, it should be explained that both sensors or only one of the other sensor can be used as desired.

In the case shown in FIG. 8, the colour testing device 63 transmits a signal 67 corresponding to the colour of the carded sliver and a signal 68 corresponding to the fiber fineness to the control units 7, 7.1, 7.2, 44 mentioned in FIGS. 1 to 7, which control the individual fiber components in each case. A further signal 81, corresponding to the quantity of the carded sliver (kgs/hr) is likewise transmitted by the card control unit 64 to the control units 7, 7.1, 7.2, 44. These three signals are compared in every case by the aforesaid control units with the specified nominal value entered in the control for the fiber fineness and with the nominal value for the performance, so that, if deviations arise in the course of the operation, these can be rectified by the alteration of the component blend and the performance.

The product delivered by the blender 6 is conveyed via a conveying system 69 to the cleaning section 60 and from the cleaning section 60 via a conveying system 70 to the card 63. Such conveying systems can be mechanical or pneumatic, likewise, it is also well known that conveying systems exist between fine cleaning and coarse cleaning machines.

The method according to the invention is likewise not limited to a single cleaning section and to a single card 63 after the blender 6, but rather, either more cleaning sections 60 and more cards 63 can be supplied with the product from the blender 6, or, if a cleaning section is provided after the blender 6, then a plurality of cards 63 can be supplied with the product of the cleaning section 60.

When a plurality of cards are provided, the optionally a colour checking apparatus 65 and/or a fiber fineness checking apparatus 66 can be provided after every card, or if several cards process the same product it is possible that only a so-called master carding machine has the two last named test instruments.

FIG. 9 shows the possibility of providing the cleaning section 60 between the fiber opening and the component cells 9, so that a ready-cleaned fiber material is available in the component cells 9 for the blending.

The conveying installation from the fiber bale opening device 20 to the cleaning section 60 corresponds basically to the pneumatic conveyor pipe 211 whereby, in this case also, pneumatic conveying is not obligatory but can also be mechanical.

The transport between the cleaning section 60 and the component cells 9 can likewise be a pneumatic conveyor pipe 21, it can, however, be any conveying system. The method according to the invention is not limited to any particular conveying system.

Likewise, the provision of the cleaning section is not limited to the combination with the arrangement from FIG. 3. It is clear that the fiber components of all the arrangements shown in the figures, with the exception of FIGS. 6 and 7, are cleaned first and then arrive in the blender. It is, however, a question of cost, as a cleaning section must be provided for the components according to FIGS. 1, 2, 4 and 5. FIG. 10 shows a variant of the method of FIG. 9, in that the cleaning section is divided into coarse cleaning with the cleaning machines 61 and a fine cleaning section with the cleaning machines 71. A storage container 72 is inserted in each case before each of these items. For the sake of simplicity, only one container is shown.

The fine cleaning machines 71 are started or stopped through a control unit 73, and indeed are stopped on the basis of an empty indicator 74 and are started on the basis of a full indicator 75 (only one of which is shown). These full and empty indicators transmit their signals to the control unit 73 via the leads 76 and 77.

The supply of the coarse cleaning machines 61 is effected by means of a fiber transport installation 78 which can be the pneumatic conveyor pipe 21 from FIG. 9 or any well known fiber transport installation.

The same applies to the fiber transport 79 between the coarse cleaning machine 61 and the storage containers 72. The fine cleaning machines each pass on their products to a component blending cell 9, as was already described for FIGS. 2 to 4 and FIG. 9.

Correspondingly, the elements already described are designated with the same reference numbers and are not further described for these figures.

In operation, the components are individually cleaned, correspondingly the empty indicator 15 of the individual component cells requests the opening of fibers from the corresponding fiber bale groups a or b or c or d, in order to clean these opened fibers in the coarse cleaning machine and to pass them on to the appropriate storage container 72, which passes the specified components on to the subsequent fine cleaning machine 71.

This product demand is effected through the empty indicator 15 because the corresponding fine cleaning machine does not continue to deliver the product, as the empty indicator 74 in the storage container 72 has likewise indicated the empty state. Accordingly, opening continues from the appropriate group a to d until the appropriate full indicator 75 indicates full with the opened components. Therewith, the appropriate fine cleaning machine can be put into operation again, until the full indicator 14 of the component cell 9 again shows full.

The fiber transport between the blender 6 and the card 63 can be a fiber transport installation which is designated and described with 70 in FIG. 8. Likewise, it also holds for this variant that a blender 6 can serve several cards, so that the fiber transport installation 80 can transport the product from the blender to the corresponding number of cards.

The control process is now explained more closely, starting with FIG. 111 which deals particularly with the embodiment of FIG. 2. In order to explain the conformity between FIGS. 11 and FIG. 21 the same parts have been designated with the same reference symbols. It can be seen from FIG. 11 that the fiber bale opening device opens various components and delivers them into the respectively associated component cell 9 of a blender 6. In contrast to the four components of the embodiment of FIG. 2, eight different components are provided here, but the principle is the same. The metering devices 11 of the individual component cells 9 are not shown in FIG. 11, but they are controlled from the control unit 7.1 via control leads 12 from the control unit 7.1 according to the embodiment of FIG. 2.

The blended product of the HF blender 4 is then fed to a coarse cleaning unit 61 and the coarsely cleaned product is then passed to a fine cleaning unit 62.2. These fine cleaning units are not shown in the version of FIG. 2, but they can be provided in exactly the same way. The finely cleaned product coming from the fine cleaning unit 62.2 is then fed to the filling shafts of six cards 63.1 working in parallel.

Two of the six cards are provided with fiber fineness measuring devices (Micronaire), the output signals 68 of which are transmitted to the control unit or regulator 7.1. Two further cards are provided with colour checking equipment 65 for the on-line measurement of the colour of the carded sliver, whereby the appropriate signals 67 are likewise fed into the control unit 7.1.

Furthermore, a further signal 81 corresponding to the carded sliver production (kgs/hr) is fed into the control unit 7.1 from the card control unit.

Further on-line measurement parameters are also taken into account by the control unit 7.1, for example the measurements of the staple or the extensibility of the carded sliver and also the dirt content, fiber strength et cetera.

The control unit 7.1 consists of two main blocks (1001 101) whereby the block 100 receives the requirements of the spinning mill management, for example at an entry keyboard (user dialogue) (102), and calculates the actual regulation parameters from this. Stated more exactly, data concerning the origins of the individual fiber components in the individual shafts (uses) 9 of the blender, are first entered on the keyboard 102. These components are designated with X1 to X8 in FIG. 11 and the control unit 7.1 receives data for instance for every component concerning the fineness (Micronaire), the staple of the fibers, the grade of the contamination, the strength et cetera. These data are entered into the memory indicated in field 104. The arrow 106 shows that the appropriate data cannot only be entered manually, but possibly via a lead from the bale management department, which is represented here by the field 108. For example, the field 108 could be a code reading device, which reads the coded statements concerning the characteristics of the fibers of the particular bales of individual origins and stores the signals in the control unit 7.1 via the lead 106.

In addition to these entries, the control unit 7.1 receives the wishes of the spinning mill management concerning the desired proportions of the individual components X1 to X8 via the entry keyboard 102. These wishes concerning the desired component distribution are retained in a memory, which is designated with 110.

With the establishment of the desired component proportions, the spinning mill management can, for example, take account of the stocks of the individual components as well as the need to use a certain quantity of waste components with the output. With the example represented, the waste is given as component X8, of which, according to the desired composition, a proportion of 3% should appear in the carded sliver. Naturally, the desired component distribution must not only take account of the stock position but must also reflect the desired carded sliver product.

Furthermore the control unit 7.1 receives data concerning the desired carded sliver characteristics, that is, the permitted ranges of the characteristics of these carded slivers, which are stored in the memory which is designated with the reference symbol 112. The desired characteristics can, for example, be characteristics such as fineness, staple, colour ductility, price, etc., whereby the number of characteristics is not limited, but rather the algorithm must be set out in such a way that all the characteristics entered can also be taken into consideration.

A priority memory is indicated by field 114, which contains a specified sequence of control priorities. With the example shown, the fineness of the carded sliver is in the first position, the staple is in the second position, the necessity for 3% of waste in the form of component X is in the third position, the colour is in the fourth position and, in the fifth position is the wish for the processing of at least 25% of the component Xl, since this component can be purchased at favorable prices. With the example shown, the sequence of the entries also represents a weighting of the control priorities. However, it is also possible to allocate a special weighting for every priority. Characteristics which are not specially listed as priorities are then weighted with a zero or low priority by the control.

The contents of the memory fields 104, 110, 112, 114 can, for preference, also be represented on a video screen, so that the user can determine right away which entries are decisive for the control at the time. If desired, all the fields can be shown on the screen simultaneously or only single fields selectively, if necessary, with additional remarks, insofar as this is required by the user.

The control unit 7.1 or stated more exactly, the microprocessor 100, then calculates a component breakdown which takes into consideration the data of the origins of the individual components as well as the control priorities, if necessary, under the consideration of the weighting of the control priorities, and produces a carded sliver which lies within the desired ranges of characteristics and which comes as close as possible to the desired percentage of component. The calculation of this percentage of component is indicated by the field 116 of the microprocessor 100. The calculation of the control parameters that is the percentages of the components or component distribution, which is preferably expressed in mass flows, is effected in such a way that the sum of the deviations weighted according to priorities between the specified values and the actual values is as low as possible. Thereby, the values from the desired percentage of component are also regarded as specified values, usually with a low priority weighting. Through this special method, that is, the treatment of the values of the desired percentage of component as specified values, it is certain, according to the invention, that the feedback loop is always mathematically determinated, so that optimization is possible with an unambiguous result.

The control sizes or mass flows calculated in Field 116 from the individual origins X1 to X8 then form the nominal or desired values for the feedback circuit 118, which ensures that the corresponding mass flow values are actually observed.

After this it is possible to measure some technological values of the carded sliver on-line, for example the fineness (Micronaire), the colour and also the production, then, in this way, the carded sliver characteristics can be drawn into the control 118, which is indicated with the appropriate signals 68, 67, 81 in FIG. 11. If these values lie outside the ranges of tolerance which are given in the memory 112, then the component proportions X1 to X8, that is the appropriate mass flows according to the principle of minimum weighted deviations from carded sliver characteristics and component proportions, are calculated anew, taking the actual deviations from the carded sliver characteristics into consideration, at least regarding the Micronaire and colour values. These newly calculated corrected values X1 to X8 are then used for the mass flow control in the blender 6. It is also taken into account with this control, that there is a delay time (dead time) TZ between the emergence of the components from the metering apparatus of the blender 6 and the outflow of the corresponding carded sliver from the cards. It is therefore assumed in the schematic diagrams for FIG. 11, that no damage to the staples is caused in the coarse cleaning unit 61 and the fine cleaning unit 62.1 and 62.2, as well as in the cards. Also, it is assumed that dirt is eliminated as completely as possible, whereby this elimination can take place in the cleaning units 61, 62.1 and 62.2 as well as in the individual cards 69.1.

However, even when the cleaning units, above all the fine cleaning units, cause a certain amount of damage to the staple, that is, shortening of the staple is brought about, then this is reflected in the carded sliver. As the on-line measurement of staple is relatively difficult at the present time, then samples taken from the carded sliver can be examined in the laboratory, in order to determine the actual staple. If the actual measured staple deviates from the staple calculated in the Field 116, then, on the one hand, this is an indication that either the fine cleaning units or the cards have caused this staple shortening. The actual measured value of the staple and possibly that of other measured values can be considered exactly as with the Micronaire and colour values in the control unit 118 in the framework of a calculation of new component proportions Xl to X8 according to the principle of the minimum weighted deviation from carded sliver characteristics. This also applies to other technological values which can be measured in laboratory.

The coarse cleaning machine is a very protective type of cleaning with regard to fiber damage but which mainly eliminates the coarse dirt only, so that the finer dirt must rather be eliminated in the more intensive fine cleaning machines, which brings about the possibility of damage to the fibers. It is also possible with the coarse cleaning that relatively short staple fibers are eliminated with the contamination, so that the setting of the coarse cleaning unit can also bring about an alteration of the staple.

One possibility of taking this into account is shown in FIG. 12, in which in contrast to FIG. 11, the coarse cleaning unit 61 is arranged between the fiber bale opening device 20 and the blender 6. The control unit 7.1 is constructed substantially in the same way as the corresponding control unit in FIG. 11, with the exception that the microprocessor 100 receives a communication concerning the actual setting of the coarse cleaning unit via the lead 120. This setting is taken into consideration with the calculation of the control sizes in the Field 116, and indeed with regard to the possible elimination of short staple fibers as well as coarse contamination. It is also possible to control the coarse cleaning unit via the leads 122 from 116, so that a specific elimination of short staple fibers and/or contamination ensures.

As the coarse cleaning unit is located between the fiber bale opening device 20 and the blender 6, it is also expedient to measure the data concerning the fibers of different origins on the basis of samples taken from the cells 9 and enter these in the memory 104 first, as, in this way, the effect of the coarse cleaning unit with regard to the staple of the individual components as well with regard to the contamination content of the fibers of different origins can be taken into account at once.

With this example, the fine cleaning units 62.1 and 62.2 are inserted between the blender 6 and the cards 63.1, which are driven in parallel. With this example, the sensorics and factories for the coarse cleaning unit are connected to the computer 100, which, however, is not absolutely essential. It is possible for the cleaning machine to be provided with its own control, but it is important in this case that the product should be examined after the coarse cleaning unit, in order to assess the effect of the unit on the individual components with regard to staple alterations and elimination of contamination.

FIG. 13 shows that it is also possible to likewise insert the fine cleaning units 62.1 and 62.2 between the fiber bale opening devices 62.1 and 62.2. In this case also, the sensoric and actorics for the fine cleaning units can be connected to the computer 100. For this reason, the computer can be informed regarding the actual setting of the fine cleaning units via the leads 124, 126 and therefore can also assess the effect of the fine cleaning unit with regard to the elimination of contamination, fiber damage and staple shortening. The computer can also control the fine cleaning unit via the leads 128, 130 in such a way that the desired degree of the elimination of contamination results and that the staple shortening which occurs remains within predetermined limits.

With the arrangement according to FIG. 13, it is also possible to provide the cleaning units 61, 62.1 and 62.2 with their own controls and to determine the effect of these units on the fibers of individual origins by taking samples from the component cells 9 of the blender 6. In other respects, it is easy to see from FIG. 13 that the control unit 7.1 can be effected in correspondence with the control unit shown in FIGS. 11 and 12, which is the reason why the same reference symbols have been used for the same parts.

Finally, FIG. 14 shows a control process according to FIG. 111 whereby an automatic batch change from the batch control 7.1 is also effected.

In the preparation of a batch change, the carded sliver characteristics, control priorities and the desired percentages of components are newly entered in accordance with the altered yarn requirements and new control sizes calculated. The following procedure takes place after the start of the batch change has been actuated.

Firstly, the metering elements in the blender 6 for the individual components are reset, so that the new batch composition appears at the outlet of the blender. A period of time, dependent on the production rate is then allowed to pass (this time amounts to about 2 minutes in a practical example) and a can change is then automatically initiated via the control lead 132. This means that the cans at the outlet of the cards, which are partly filled with the old batch, are changed over to new cans, which then take over the carded sliver of a transitional batch with the altered characteristics. One can then determine via the card sensors, for example from those sensors for Micronaire and colour, how long these characteristics are changing, i.e. when the characteristics have stabilized. The corresponding investigation is undertaken by the control on the basis of the signals transmitted over the control leads 87 and 67. As soon as it is certain that the alteration in the characteristics has stabilized itself, then a can change is automatically carried out on all the cards. The contents of the cans which were partly filled during the alteration of the characteristics is to be regarded as sliver waste and an be used for the waste component X8, for example. After the stabilisation of the alteration in characteristics, the newly placed cans receive a carded sliver of the new batch, which is subsequently spun into yarn.

Instead of referring to the signals of the Micronaire and colour sensors for the second automatic can change, it is only necessary to wait for an adequate period of time before the can change is initiated to allow for the new setting of the metering apparatus for the new batch. However, this leads to more sliver waste, as more generous safety factors are required.

With the control process of FIGS. 11 to 14, the control signals for percentages of the components, that is the mass flows X1 to X8 are applied via the control lead 12, to the metering devices of the individual component cells 9 of the blender 6. However, it is clear, for example with the arrangement according to FIG. 1, that the appropriate signals are also used for the control of the bale opening organs 3 and/or the conveying elements 1, so that the control can undertake the regulation of the component distribution of the batch of material in this way.

In order to explain the procedure for deriving the respectively desired component distribution in accordance with the invention as a basis for the subsequent adjustment of the bale opening and mixing system a preferred method will now be described in more detail with reference to the computing steps to be effected.

The starting point for this method variant is the desire to mix a predetermined number of fiber components with the quality features and the price of each fiber component being known. This method assumes that the quality of the resultant mixture is known, at least in terms of its desired characteristics. The quality of a mixture will be understood to mean the characteristics of the fiber mixture which are for example reflected in the characteristics of the card sliver or of the finished yarn. Stated more precisely, the mixture composition is to be determined which comes closest to the desired quality and of which the price is in any event a minimum. The mathematical side can explained as follows:

a) Notation conventions

- scalars and vectors are symbolically illustrated with small letters, matrices with large letters.
- $x=[x1, x2, \ldots, xn]$; x designates a row vector with the vector components x1, x2, to xn.

$y=[y1, y2, \ldots, yn]'$; y designates a column vector with the vector components y1, y2, to yn.

It can be seen from the context whether one is concerned with a column vector or a row vector.

- Significance of special symbols:
  - '. . transposition
  - * . . multiplication b) Analysis of problem It is assumed that linear mixing laws apply to all quality features. The mixture quality q is computed in accordance with equation (1).

$$q=QK^{*}c \quad (1)$$

q . . is a vector, the components of which describe the individual quality features of the mixture.

QK . . is a matrix, the elements of which describe the individual quality features of the component to be mixed. In the representation QK=[q1 q2, . . , qn]qi having the integer numbers i=1 . . n, are the column vectors of the component qualities, c . . is a vector, the components of which describe the individual proportions of the components to be mixed.

Two characteristics of C=[c1, c2, . . , cn]:

(i) 0=<ci=<1 for the integral numbers i=1 . . n (ii) 1=cl+c2+. . +cn

The price of the mixture, computed as a scalar product in accordance with equation (2)

$$p=pK'^{*}c \quad (2)$$

p . . is the price of the mixture, for example in Dollars/-kilogram pK . . is a vector the components of which describe the prices of the individual components to be mixed.

Discussion of equation (1)

Equation (1) is a linear equation in c. If one first ignores the side conditions which the mixing vector c must satisfy then linear algebra teaches that equation (1) then and only then has a solution when q (vector of the mixing quality) can be portrayed as a linear combination of the vectors qi (vectors of the component qualities). Equation (1) is thus only soluble if the rank(QK)=the rank(QK,q).

If equation (1) is solvable and if rank(QK)=n-r, then this signifies that r components of the mixing vector c can be freely selected.

If equation (1) is not solvable, (for example if more quality features are present than mixing components) then at least that mixture c should be determined which comes closest to the required quality. The method to be used is well known, it is the equilibrium calculation.

More precise statement of the underlying problem:

An algorithm is sought which delivers that mixing vector which comes as close as possible to the desired mixture quality and which is physically realisable in that it satisfies the side conditions. Individual components of the mixing vector should be capable of being fixedly preset. The price of the mixture should be as low as possible. The problem is generally only solvable if a certain preparedness to compromise exists. The compromises which will be accepted with respect to individual quality features of the mixture should be capable of being preset with weighting.

c) The solution

A loss function v(c) is defined in equation (3) with which the generalized losses can be measured. These losses arise in that the desired quality features of the mixture cannot be fully achieved and in that a price different from zero has to be paid for the mixture. The price is, at least from the book keeping point of view, on the debit side or loss column. The deviations of the achievable mixture quality from the desired quality and the mixture price are additionally weighted:

$$v(c)=(QK^{*}-q)'^{*}W^{*}(QK^{*}c-q)+w^{*}c'^{*}p^{*}c \quad (3)$$

W . . is a positive semidefinite diagonal matrix for the weighting of the quality deviation of the mixture from the desired quality, P . . is a positive definite diagonal matrix, the elements of which are the prices of the components, w . . is a scalar for weighting the influence of the price.

All mixing vectors should additionally satisfy the side condition of equation (4). This equation gives expression to the fact that the sum of the mixing components must be 1 (see part 3, characteristic (ii)).

$$g(c)=o=k+e'^{*}c \quad (4)$$

e . . is a vector of the same dimension as c, the elements of which are all 1, k . . is a scalar (k=−1, when all components of c can be freely selected).

That mixing vector c is sought for which the function value v(c) is a minimum and which satisfies the side condition of equation (4). In addition the side conditions of equation (5) must be observed:

$$o=<ci=<1 \text{ for the integers } i=1 \,..\, n \quad (5)$$

This problem is solved stepwise.

1st step

The system of equations comprising the equations (3) and (4) is solved in accordance with the rules of differential calculus. This leads to an ideal mixing vector cl. If the side conditions 5 are not infringed then the problem is solved, otherwise the second step is carried out.

2nd step

One component of c which infringes the equation (5) is set by hand to a fixed value which is compatible with equation (5). The mixing value c is thus restricted by one dimension. In equation (4) k is so determined that the significance of that equation remains valid. The lst step is then executed again which leads to an ideal mixing vector c2.

The steps 1 and 2 are executed until in step 1 the side conditions of equation (5) are not infringed. The method ultimately breaks down when all components of c are set by hand to fixed values.

The way in which the above described mathematical computations now appear for certain specific examples is now shown by the accompanying tables of FIGS. 15 and 16.

The table of FIG. 15 shows first of all in the first row the time at which the calculation is carried out, and indeed through statements relating to the year, month, day, hour, minute and second. These statements are not of particular importance for the method of the invention they simply enable a time association of the computation to the work in the factory. It is important that in the example shown here six different components x1 to x6 are present (in place of the eight components x1 to x8 of the previous examples) which is why the upper part of the table has six columns. For each component, five different characteristics are set forth in the present example. These are the following five characteristics:

1. the mean staple length of the component,
2. the fineness of the component expressed in Micronaire values,
3. the colour value FAK of the individual components,
4. the colour value FBK of the individual components, and 5. the price of the respective components, for example in Dollars/kg (preferably corrected to take account of the contamination which is present.

At this stage it should be emphasised that this is only one example. In practice the same method can be used to used to take account of other characteristics or further characteristics or fewer characteristics of the individual components and with any other number of components.

In the central part of the table there is then shown the result of a first optimization using the above described mathematical method. The same five values are also quoted for the mixture itself, i.e. The staple length of the mixture, the fineness of the mixture, the colour value a of the mixture, the colour value b of the mixture and the price of the mixture. The first quoted values in this representation are the actually computed values (step 1). Special attention should be paid to each of the S and W values given in brackets. These are namely the desired values S and the weighting values W. These values are fed into the computer prior to carrying out the optimization, for example via the keyboard 102 of FIG. 11.

One can see from this example that the desired value for the staple of the mixture is 16, that the desired value for the fineness of the mixture is 4, that the desired colour value a is 1, that the desired colour b is 3 and that the desired price of the mixture should be 0, i.e. The desired price should be kept as low as possible. With regard to the weighting the staple, the fineness and the colour value b all have the same weighting of 1. In contrast the colour value a has a weighting of 0, since in this example all colour values a have the same value 1, so that with this mixture a change of the colour value a of the mixture cannot be achieved because changes of the percentages of the individual components do not lead to any change of the colour value a of the mixture. Accordingly the weighting here is completely irrelevant and it is recited with zero. The weighting of the price has intentionally been set relatively low and indeed in order to prevent the computer over-emphasising the price. If a trick of this kind were not used then the danger would be great that a computer program would lead to an excessively high percentage of the favorable price component x5 with large compromises for the other technical values, which are indeed ultimately the determining factor for the saleability of the fiber product.

As explained above the computer program endeavours to keep the loss function as small as possible and indeed actually equal to zero. In this endeavour the proportions for the individual components are computed which fall under the designation "mixing vector C1". i.e. this mixing vector specifies the component distribution. It is notable here that the statement regarding the proportion of the component x3 is negative which would not be possible in practice, since in order to realize this one would have to subtract a quantity of x3 from the mixture which is not meaningful or practicable.

Thus the operator is forced to set the value zero for x3 since it is not absolutely essential that any percentage of this component be present. With this statement the computer carries out a subsequent optimization, i.e. a correction of the computed values. Here the computer also endeavours to keep the value of the loss function as small as possible and indeed taking account of the additional boundary condition that x3 must be equal to zero.

With this boundary condition the computer reaches a corrected component distribution with the proportions of x1, x2, x4, x5, x6 being 0.4536, 0.3101, 0.0171, 0.014 and 0.0791 respectively. Interesting for the operator are also the values which are now printed out for the staple, for the fineness, for the colour values and for the price. The operator can see at once that the calculated characteristics of the fiber mixture, i.e. of the card sliver or of the yarn lie very close to the preset desired values. He also notes that the price resulting from the omission of the component x3 has only increased fractionally from 2.581 to 2.631.

The result of the post optimization shows the value of the loss function as likewise being zero. In fact this value is not equal to zero but simply so low that it is not shown by the program that has been used. In an attempt to achieve a specific value for the loss function which is then more suitable for comparison purposes the same example has been computed once more with the weightings all being increased by the factor 1000. The result of this variant is then shown in table II of FIG. 16. One notes here that with otherwise unchanged data in the upper and middle part of the table the loss function is now shown with the value 0.135.

The other part of the table II shows a result of a post optimization which has however been carried out using data which differs from the statements of table I. Here it is also necessary to specify the proportion of the component x3 with zero. Furthermore, it has been decided that for the components x5 and x6 precisely the same proportions should be present in each case as only relatively little remains of these components and the management of the spinning mill wishes to ensure that these residual quantities are fully used up and simultaneously disappear out of the inventory. It has also been chosen that no proportion of the component x4 should be added here since this component is temporarily not available. All these further boundary conditions lead to a poorer result being attained after post optimization, although one can still speak of an optimization since under the given boundary conditions the result of the post optimization is, under the circumstances, truly an optimum. The operator now sees at once that the staple of the mixture is now 16.66 which deviates relatively far from the desired value of 16. The relatively large deviation can also be found by the fineness of the mixture. For the colour value "a" only a small deviation is present which is also to be expected since all components have the same colour value "a". For the colour value "b" the deviation is not particularly pronounced. It is however of particular economic interest that the price for the mixture now amounts to 2.768 in place of the previous optimum of table I of 2.631 so that here a substantial deterioration can also be seen. The value of the loss function has now increased to 0.548 which confirms that considerable deviations from desired values are present here.

If the user is agreeable to the values which have been shown to him (e.g. on a display screen), then the can pass on the particulars for the mixture proportions to the control for the mixture proportions by feeding in a corresponding command, for example "confirmed", and these proportions are then the determining factor for the corresponding desired values for the individual components. The tables thus reproduce the content of the user dialogue. Each user dialogue takes place in a manner very similar to the scheme of FIG. 11 with the exception that it is not necessary here to first date a desired component distribution although it is entirely possible to specify certain values for certain components, as explained in connection with the tables. Thus with this variant the fixed proportions of certain components represent boundary conditions for the calculation.

Although, for the purpose of illustration, the result of the first optimization shows a negative value for the component x3 it is entirely possible to effect the program in such a way that the computer program can always set such negative values to zero and carries out the optimization again. This would then lead to the result of the post optimization of table I being the result of the first optimization (so far as the user is concerned) whereupon the user, if desired, can feed in further boundary conditions if the values deduced by the computer do not suit him for particular reasons.

We claim:

1. A method of mixing textile fibers obtained from a plurality of fiber bales of different origins, said method comprising the steps of inputting data indicative o the characteristics of the fibers of each fiber bale into a regulating system;

inputting data into the regulating system indicative of an estimated quantitative component distribution of the proportions of fiber to be taken from each fiber bale for a fiber mixture;

inputting data indicative of the desired characteristics of one of a card sliver and a yarn to be manufactured from the fiber mixture into the regulating system;

thereafter calculating from all the inputted data in the regulating system a component disruption which comes close to said estimated component distribution and which satisfies said desired characteristics of the card sliver in accordance with a given regulation algorithm;

delivering the fibers from the fiber bales to a mixer for mixing the fibers into a mixture; and controlling the operation of the mixer in accordance with said calculated component distribution to obtain a fiber mixture with the calculated component distribution.

2. A method as set forth in claim 1 which further comprises the step of inputting the data into the regulating system indicative of at least one regulation priority whereby at least one component proportion or a card sliver characteristic has precedence.

3. A method as set forth in claim 1 wherein a plurality of regulation priorities is inputted into the regulation system ad each regulation priority is weighted relative to the other regulation priorities.

4. A method as set forth in claim 3 wherein said regulation priorities are weighted in dependence on the sequence of the inputted data.

5. A method as set forth in claim 1 which further comprises the step of measuring at least one of the desired characteristics of the sliver during manufacture of the sliver to obtain a measured value thereof;

delivering said measured value to the regulating system for comparing to the inputted value of said desired characteristic; and re-calculating the component distribution in the regulating system in response to a deviation of said measured value from said inputted value of said desired characteristic.

6. A method as set forth in claim 5 which further comprises the steps of measuring at least one of said desired characteristics of a sliver or a yarn in a laboratory to obtain a measured value;

comparing the measured value with a desired value of said desired characteristic; and inputting data into the regulating system indicative of a deviation of the measured value from said desired value for re-calculating said component distribution.

7. A method as set forth in claim 5 which further comprises the steps of measuring said desired characteristics of the sliver over a period of item to obtain a plurality of measured values and forming a means value of said plurality of measured values for delivery to the regulating system.

8. A method as set forth in claim 1 wherein said step of calculating a component distribution is performed in accordance with the principle of minimum deviations from the inputted desired characteristic data.

9. Method in accordance with claim 8, characterized in that the computation of the component distribution takes place in accordance with the principle of minimum quadratic deviations or minimum weighted quadratic deviations from the inputted characteristic data.

10. A method in accordance with claim 8, characterized in that the computation of the component distribution takes place in accordance with the following equation or the following regulation algorithm in that the quality criteria $$J(u) = \int_{o}^{\infty} \{x^T(t)\, Q\, x(t) + u^T(t)\, R\, u(t)\} dt$$

is minimized where x(t) recites the regulation deviations in the form of a vector, i.e. The deviations of the measured characteristics from the desired characteristics, $X^T(t)$ is the transform of x (t)

u(t) is the control vector which recites the desired component distribution, $u^T(t)$ is the transform of u(t), Q and R are matrixes with which the individual components in x(t) and u(t) are weighted.

11. A method as set forth in claim 1 which further comprises the step of controlling a coarse cleaning unit between a bale opening machine and the mixer in accordance with said calculated component distribution.

12. A method as set forth in claim 1 which further comprises the steps of changing the material composition of the sliver to be produced;

re-calculating the component distribution for the sliver to be produced in dependence on the change in material composition; and coordinating said re-calculation of the component distribution with a sliver can change to effect a transition to said material composition from a former material composition without interruption.

13. A method of mixing fibers to form at least one of a sliver and a yarn, said method comprising the steps of inputting data indicative of the characteristics of the fibers in each bale into a computer;

inputting data into the computer indicative of the desired characteristics of one of a sliver and a yarn to be manufactured from the fibers;

delivering the fibers from the bales to a mixer for mixing the fibers into a mixture;

calculating a component distribution of the fibers in the computer in accordance with a given regulation algorithm from all said inputted data; and controlling the operation of the mixter in accordance with the calculated component distribution to obtain a fiber mixture with the calculate component distribution.

14. A method as set forth in claim 13 which further comprises the steps of inputting additional data into the computer indicative of at least one of a boundary condition for at least one desired characteristic; and correcting the calculated component distribution in dependence on said additional data.

15. A method as set forth in claim 13 wherein the computer is connected to said mixer for regulating the operation of said mixer.

16. A method as set forth in claim 13 which further comprises the step of feeding a predetermined statement of quantity for at least one component of said mixture into the computer as said boundary condition.

17. A method as set forth in claim 13 wherein said data for at least one of the desired characteristics is weighted relative to the other o the desired characteristics of said calculation step.

18. A method as set forth in claim 13 which further comprises the steps of feeding additional data indicative to the cost of each component of the fiber mixture into the computer and calculating said component distribution independence thereon to minimize the total cost of the calculated component distribution.

19. A method as set forth in claim 19 wherein said cost of each component is a refined cost determined after removal of contamination from purchased fiber material.

20. A method as set forth in claim 10 wherein said calculation step takes place in accordance with the equation $$v(c)=(QK^{*}-q)\text{'''}W\text{''}(QK^{*}c-q)+w^{*}c'^{*}p^{*}c$$

taking account of the boundary condition $$g(c)=o=k+e'^{*}c$$

and also of the boundary condition $$o=<ci=1 \text{ for the integers } i=1 \quad \ldots n,$$

wherein:

c . . is a vector, the components of which describe proportions o the components to be mixed QK . . is a matrix, the elements of which describe the individual quality features of the component to be mixed.

'. . transposition

* . . indicates multiplication q . . is a vector, the components of which describe the individual quality features of the mixture.

W . . is a positive semidefinite diagonal matrix for the weighting of the quality deviation of the mixture from the desired quality, w . . is a scalar for weighting the influence of the price.

e . . is a vector of the same dimension as c, the elements of which are all 1 p . . is the price of the mixture, the example in Dollars/kilogram k . . is a scalar (k - −1, when all components of c can be freely selected).

* * * * *

UNITED STATES PATENT AND TRADEMARK OFFICE

CERTIFICATE OF CORRECTION

PATENT NO. : 5,282,141

DATED : January 25, 1994

INVENTOR(S) : J. Trannello

It is certified that error appears in the above-identified patent and that said Letters Patent is hereby corrected as shown below:

On The Title Page

In the abstract:

Line 5 change "board" to -card-
Line 12, change "car" to -card-
Line 20, change "si" to -is- Column 1, line 11, change "for" to -fro-
Column 3, line 2, cancel "on system...operation of a"
Line 3, change "the regulative" to -the regulation system so controls the operation of a-
Column 4, line 25, change "RO" to -R-
Column 6, line 53, change "cad" to -card-
Column 10, line 31, change "for" to -fro-
Column 13, line 60, change "111" to -11-
Column 22, line 59, change "the" to -he-
Column 23, line 22, change "o" to -of-
Line 53, change "ad" to and
Column 24, line 15, change "means" to -mean-
Column 25, line 11, change "calculate" to -calculated-
Line 29, change "o" to -of-
Line 30, change "of" to -for-

UNITED STATES PATENT AND TRADEMARK OFFICE

CERTIFICATE OF CORRECTION

PATENT NO. : 5,282,141

DATED : January 25, 1994

INVENTOR(S) : J. Trannello

It is certified that error appears in the above-identified patent and that said Letters Patent is hereby corrected as shown below:

Line 35, change "independence" to --dependence--

Signed and Sealed this

Twenty-first Day of June, 1994

*Attest:*

*Attesting Officer*

BRUCE LEHMAN

*Commissioner of Patents and Trademarks*